US005451711A

United States Patent [19]

Kunimoto

[11] Patent Number: 5,451,711

[45] Date of Patent: * Sep. 19, 1995

[54] MUSICAL TONE WAVEFORM SIGNAL GENERATING APPARATUS USING A PLURALITY OF NON-LINEAR CONVERTERS

[75] Inventor: Toshifumi Kunimoto, Hamamatsu, Japan

[73] Assignee: Yamaha Corporation, Japan

[ * ] Notice: The portion of the term of this patent subsequent to Feb. 15, 2011 has been disclaimed.

[21] Appl. No.: 140,269

[22] Filed: Oct. 21, 1993

Related U.S. Application Data

[62] Division of Ser. No. 627,239, Dec. 14, 1990, Pat. No. 5;286,914.

[30] Foreign Application Priority Data

Dec. 18, 1989 [JP] Japan ..... 1-327655

[51] Int. Cl.[6] ..... G10H 7/00; G10H 1/08

[52] U.S. Cl. ..... 84/625; 84/622; 84/660; 84/DIG. 10

[58] Field of Search ..... 84/622, 624, 625, 630, 84/659, 660, 692, 697, DIG. 10

[56] References Cited

U.S. PATENT DOCUMENTS 5,113,743 5/1992 Higashi ..... 84/622
5,117,729 6/1992 Kunimoto ..... 84/660
5,187,313 2/1993 Inoue ..... 84/622
5,256,830 10/1993 Takeuchi et al. ..... 84/625
5,286,914 2/1994 Kunimoto ..... 84/622 X

*Primary Examiner*—William M. Shoop, Jr.
*Assistant Examiner*—Jeffrey W. Donels
*Attorney, Agent, or Firm*—Graham & James

[57] ABSTRACT

A musical tone waveform signal generating apparatus in which a waveform signal is circulated to generate a musical tone waveform signal. The apparatus includes an excitation portion for mixing an excitation control signal with the waveform signal and for non-linearly converting the mixed waveform signal and a signal transmission portion coupled with the excitation portion to feed back the converted waveform signal to the excitation portion with delay of a predetermined time for causing on the converted waveform signal a resonance frequency corresponding with a pitch of a musical tone to be generated. In the excitation portion, the non-linear conversion of the mixed waveform signal is effected by a plurality of non-linear tables to generate various kinds of musical tone waveform signals, and the converted waveform signal is controlled by a tone color control signal to simulate the musical tone as a natural musical tone created by performance of a musical instrument such as a wind instrument, a brass-wind instrument, a stringed instrument or the like.

6 Claims, 18 Drawing Sheets

MUSICAL TONE WAVEFORM SIGNAL GENERATING APPARATUS USING A PLURALITY OF NON-LINEAR CONVERTERS

This is a division of application Ser. No. 07/627,239, filed on Dec. 14, 199, now U.S. Pat. No. 5,289,914.

BACKGROUND OF THE INVENTION

1. Field of the Invention

The present invention relates to a musical tone waveform signal generating apparatus adapted for use in an electronic musical instrument, a music education system, an amusement tool or the like, and more particularly to a musical tone waveform signal generating apparatus designed to circulate a waveform signal for producing a musical tone waveform signal in response to a performance information applied thereto.

2. Description of the Prior Art

Japanese Patent Laid-Open Publication No. 6-340199 discloses a conventional musical tone waveform signal generating apparatus of this kind which includes an excitation circuit portion and a signal transmission portion, the former circuit portion having means for mixing a circulated waveform signal with an excitation control signal applied thereto from an external source of signals and a non-linear conversion circuit for non-linearly converting the mixed waveform signal into an output waveform signal to be generated as a musical tone waveform signal, and the latter circuit portion being arranged to feed back the output waveform signal to the excitation circuit portion with delay of a predetermined time thereby to obtain a resonance frequency corresponding to a pitch of the musical tone to be generated. In the musical tone waveform signal generating apparatus, the excitation circuit portion is desinged to correspond with the mouth-piece of a wind instrument, while the signal transmission circuit portion is designed to correspond with the resonance tube of the wind instrument so that the waveform signal circulated through the excitation and signal transmission circuit portions is generated as the musical tone waveform signal.

In the conventional apparatus described above, the non-linear conversion circuit is provided with only a single non-linear table for conversion of the mixed waveform signal. With such a single non-linear table, it is impossible to vary the non-linear characteristic of the mixed waveform signal at the excitation circuit portion. This means that the musical tone waveform signal is generated only in the form of a single kind of waveform signal. For this reason, the conventional apparatus is insufficient for use in an electronic musical instrument, a music education system, an amusement tool or the like.

SUMMARY OF THE INVENTION

It is, therefore, a primary object of the present invention to provide an improved musical tone waveform signal generating apparatus capable of freely generating various kinds of musical tone waveform signals.

According to the present invention, the primary object is attained by providing a musical tone waveform signal generating apparatus in which a waveform signal is circulated to generate a musical tone waveform signal, the apparatus being in combination with means for producing a first control signal for excitation of the waveform signal and a second control signal for control of a tone color and including an excitation portion having means for mixing the first control signal with the waveform signal and a non-linear conversion means for non-linearly converting the mixed waveform signal, and a signal transmission portion coupled with the excitation portion to feed back the converted waveform signal to the excitation portion with delay of a predetermined time for causing on the converted waveform signal a resonance frequency corresponding with a pitch of a musical tone to be generated, wherein the non-linear conversion means comprises a plurality of non-linear tables connected in parallel to one another to be applied with the mixed waveform signal, first means for controlling the mixed waveform signal or at least one of outputs of the non-linear tables in accordance with the second control signal, and second means for mixing the outputs of the non-linear tables and applying the mixed output to the signal transmission portion.

Alternatively, the non-linear conversion means may be composed of a plurality of non-linear tables to connected in series for successively effecting non-linear conversion of the mixed waveform signal applied thereto and for applying the converted waveform signal to the signal transmission portion and means for controlling at least one of outputs of the non-linear tables in accordance with the second control signal.

In an aspect of the present invention, the non-linear conversion means is composed of a plurality of non-linear tables respectively arranged to effect non-linear conversion of the mixed waveform signal applied thereto and selection means responsive to the second control signal to selectively apply outputs of the non-linear tables to the signal transmission portion. In another aspect of the present invention, the non-linear conversion means is designed to effect non-linear conversion of the mixed waveform signal by mathematical sum of series calculation.

BRIEF DESCRIPTION OF THE DRAWINGS

Other objects, features and advantages of the present invention will be more readily appreciated from the following detailed description of preferred embodiments thereof when taken together with the accompanying drawings, in which.

In the drawings, like reference numerals and characters designate like or corresponding parts throughout the figures.

DESCRIPTION OF THE PREFERRED EMBODIMENTS

Figure 1:
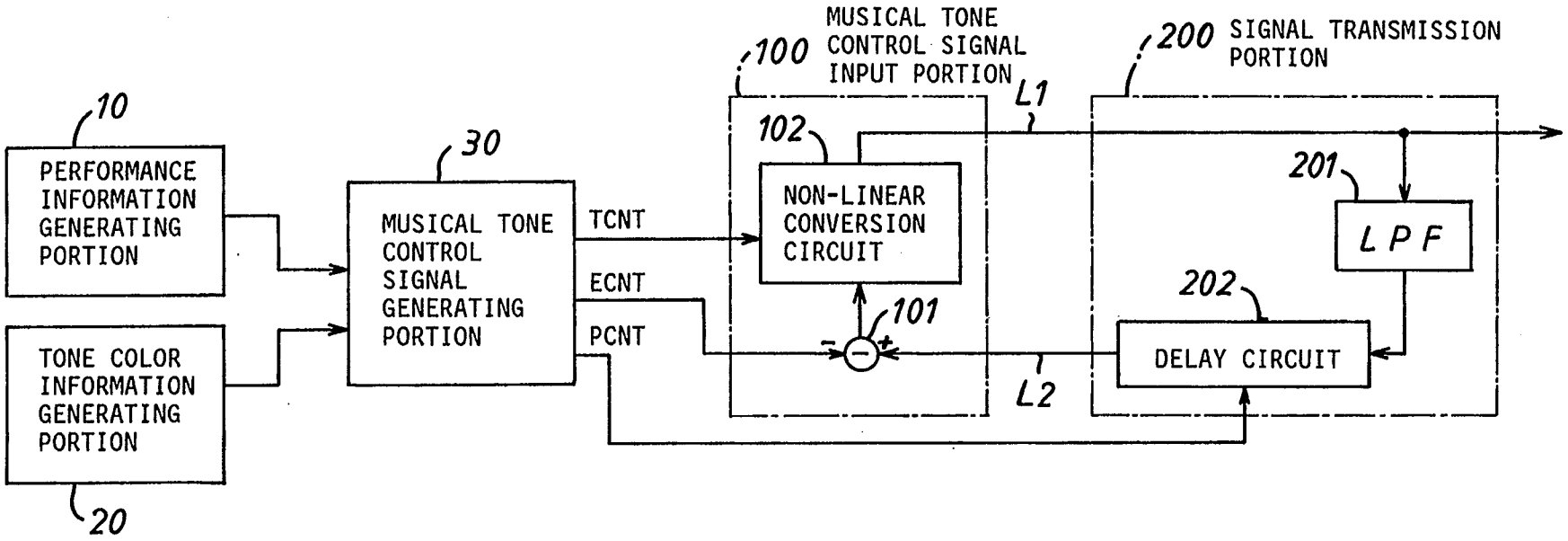
FIG. 1 is a block diagram of a fundamental musical tone waveform signal generating apparatus in accordance with the present invention.

In FIG. 1 of the drawings, there is illustrated an electronic musical instrument provided with a fundamental musical tone waveform signal generating apparatus in accordance with the present invention. The electronic musical instrument includes a performance information generating portion 10, a tone-color information generating portion 20 and a musical tone control signal generating portion 30. When applied with performance and tone-color informations from the information generating portions 10 and 20, the musical tone control signal generating portion 30 acts to generate a musical tone control signal therefrom and apply it to the musical tone waveform signal generating apparatus which includes an excitation circuit portion 100 and a signal transmission circuit portion 200.

The performance information generating portion 10 includes various kinds of performance instruments such as a keyboard having plural keys for musical scales, a mouth-controller, a wheel arranged to be rotated by the performer, a foot pedal arranged to be operated by the performer's foot or the like and various kinds of detecting circuits for detecting operated conditions of the performance instruments such as operation event, operated speed, position, depth, pressure and the like. Thus, the performance information generating portion 10 generates the resultant of detection as a performance information. The tone-color information generating portion 20 includes a selection switch for selecting the kinds of tone-color, an operation element such as a volume switch for selecting brightness or darkness of tone color and a detecting circuit for detecting an operated condition of the selection switch and operation element. Thus, the tone-color information generating portion 20 generates the resultant of detection as a tone-color information indicative of brightness or darkness of the selected tone color. The musical tone control signal generating portion 30 is in the form of a microcomputer associated with a memory in the form of a table for memorizing parameter for musical tone control. When applied with the performance and tone-color informations, the microcomputer acts to generate a pitch control signal PCNT indicative of a pitch of musical tone to be generated, an excitation control signal ECNT for exciting a circulated waveform signal and for maintaining the excited waveform signal, and plural kinds of tone-color control signals TCNT for control of the musical tone-color and effects. In this embodiment, the tone-color control signals TCNT each are represented as $TCNT_X$.

In application of the present invention to an electronic wind instrument, the various kinds of performance informations are obtainable from the performance portion of the wind instrument. In the case that another musical instrument or an automatic performance apparatus is adapted as the performance and tone-color information portions 10 and 20, the musical tone control signal generating portion 30 is applied with the performance and tone-color informations from the musical instrument or automatic performance apparatus. Alternatively, the various kinds of musical tone control signals may be formed in the musical instrument or automatic performace apparatus to be applied directly to the musical tone waveform signal generating apparatus composed of the excitation and signal transmission circuit portions 100 and 200.

The excitation circuit portion 100 includes a subtractor 101 and a non-linear conversion circuit 102. The subtractor 101 is arranged to subtract the excitation control signal ECNT from the waveform signal applied thereto from a backward signal line L2, and the non-linear conversion circuit 102 is arranged to non-linearly convert the subtracted waveform signal into an output waveform signal to be generated as a musical tone waveform signal and apply it to a forward signal line L1. In such a manner as described above, the excitation circuit portion 100 acts to simulate formation of a waveform signal produced by vibration at the mouth-piece of the wind instrument or the strings of a stringed instrument. In a practical embodiment, the subtractor 101 may be replaced with an adder taking into consideration with the excitation control signal PCNT and the polarity of the waveform signal from the backward signal line L2.

The signal transmission portion 200 includes a low-pass filter 201 and a delay circuit 202 provided on the backward signal line L2. The low-pass filter 201 is arranged to simulate a resonance of the waveform signal at a resonance portion of the respective musical instruments. The delay circuit 202 is arranged to determine a circulation period of the waveform signal or a pitch of the musical tone waveform signal to be generated. The delay circuit 202 acts to delay the pitch of the musical tone waveform signal in response to the pitch control signal applied thereto. Thus, the waveform signal on signal lines L1 and L2 is issued as an output musical tone waveform signal.

In operation of the electronic musical instrument, the musical tone control signal generating portion 30 is applied with various kinds of performance information and tone-color information from information generating portions 10 and 20 to generate the pitch control signal PCNT, excitation control signal ECNT and tone-color control signal TCNT. The excitation control signal ECNT is subtracted at the subtractor 101 from a waveform signal fed back through the backward signal line L2, and in turn, the resultant of subtraction is non-linearlly converted at the non-linear conversion circuit 102 into the waveform signal to be applied to the signal transmission circuit portion 200 through the forward signal line L1. When applied to the signal transmission circuit portion 200, the waveform signal is deformed at the low-pass filter 201 and is delayed at the delay circuit 202 to be fed back to the subtractor 101 through the backward signal line L2. In this instance, the delay circuit 202 is controlled by the pitch control signal PCNT to delay the waveform signal with a period corresponding a tone pitch at the performance information generating portion 10. As a result, the circulation period of the waveform signal will correspond with the tone pitch to provide a fundamental resonance frequency corresponding therewith. This produces a musical tone waveform signal at the tone pitch.

In a practical embodiment of the present invention, it is preferable that the non-linear conversion circuit 102 of the excitation circuit portion 100 is constructed as described below.

Figure 2:
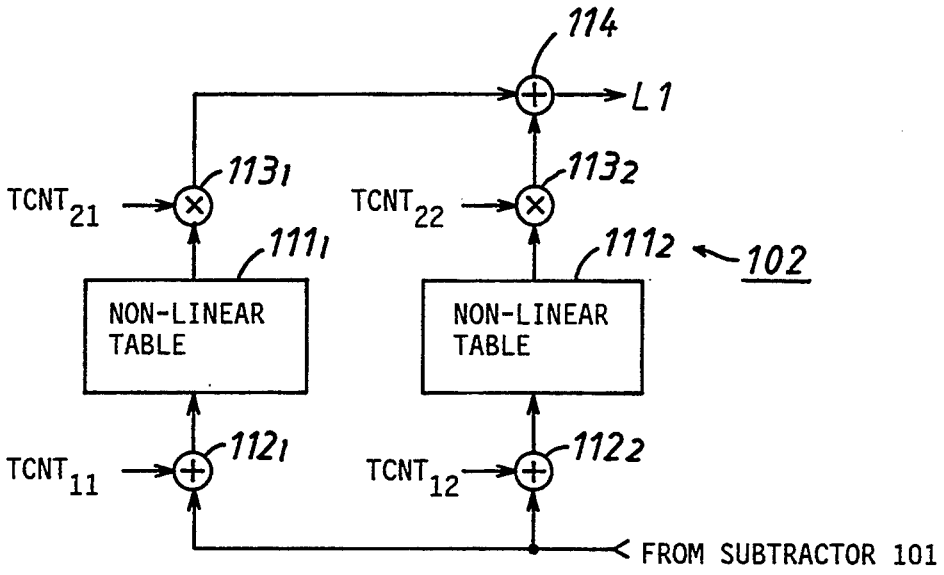
FIGS. 2 to 11 are block diagrams of preferred embodiments of a non-linear conversion circuit shown in FIG. 1.

1) Parallel type of plural non-linear tables:

As shown in FIG. 2, a non-linear conversion circuit 102 of this type includes non-linear tables $\mathbf{111}_1$ and $\mathbf{111}_2$ different in their conversion characteristics which are connected in parallel to one another. The non-linear tables $\mathbf{111}_1$ and $\mathbf{111}_2$ are connected at their input sides to adders $\mathbf{112}_1$ and $\mathbf{112}_2$ and at their output sides to multipliers $\mathbf{113}_1$ and $\mathbf{113}_2$. The adders $\mathbf{112}_1$, $\mathbf{112}_2$ are arranged to add tone-color control signals $TCNT_{11}$, $TCNT_{12}$ respectively to the resultant of subtraction from the subtractor 101 and to apply the resultants of addition to the non-linear tables $\mathbf{111}_1$, $\mathbf{111}_2$, respectively. The multipliers $\mathbf{113}_1$, $\mathbf{113}_2$ are arranged to multiply outputs from non-linear tables $\mathbf{111}_1$, $\mathbf{111}_2$ by tone-color control signals $TCNT_{21}$, $TCNT_{22}$, respectively. The non-linear conversion circuit 102 further includes an adder 114 which is arranged to mix output signals from multipliers $\mathbf{113}_1$, $\mathbf{113}_2$ and to apply the mixed output signal to the forward signal line L1.

Assuming that either the tone-color control signals $TCNT_{11}$, $TCNT_{12}$ mor $TCNT_{21}$, $TCNT_{22}$ have been varied, the waveform signals applied to or issued from non-linear tables $\mathbf{111}_1$, $\mathbf{111}_2$ are varied in response to the tone-color control signals, and in turn, the output waveform signals issued from adder 114 are varied in accordance with the tone-color control signals $TCNT_{11}$, $TCNT_{12}$, $TCNT_{21}$ and $TCNT_{22}$. This means that the non-linear conversion circuit 102 acts to effect various non-linear conversion of the resultant of subtraction from subtractor 101 in accordance with the tone-color control signals $TCNT_{11}$, $TCNT_{12}$, $TCNT_{21}$, $TCNT_{22}$. As a result, the waveform signal circulated through the excitation and signal transmission circuit portions 100 and 200 is varied in accordance with the tone-color control signals $TCNT_{11}$, $TCNT_{12}$, $TCNT_{21}$, $TCNT_{22}$.

Figure 3:
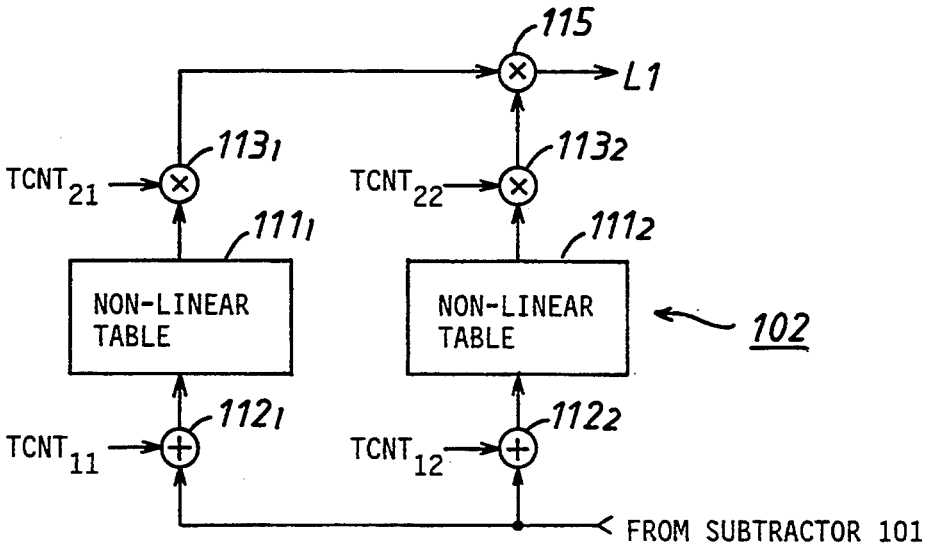
Figure 4:
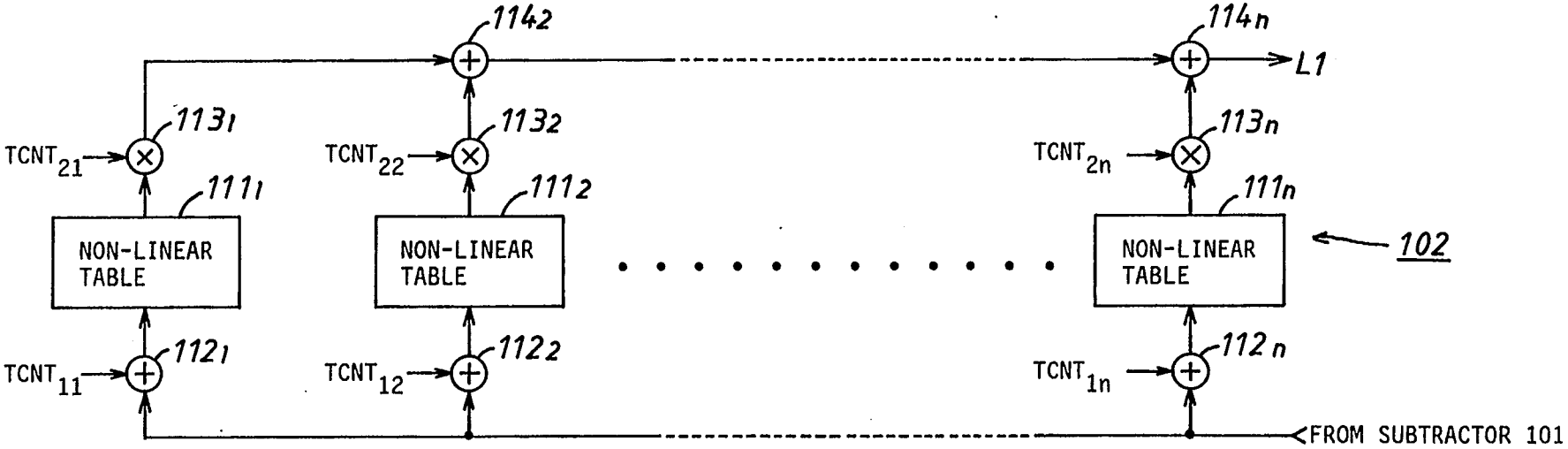

As shown in FIG. 3, the adder 114 of FIG. 2 may be replaced with a multiplier 115 which are arranged to multiply the non-linearly converted waveform signals applied thereto from non-linear tables $\mathbf{111}_1$, $\mathbf{111}_2$ respectively through the multipliers $\mathbf{113}_1$, $\mathbf{113}_2$ thereby to issue the multiplied waveform signals on the forward signal line L1. As a result, the waveform signal circulated through the excitation and signal transmission circuit portions 100 and 200 is varied in accordance with the tone-color control signals $TCNT_{11}$, $TCNT_{12}$, $TCNT_{21}$, $TCNT_{22}$. As shown in FIG. 4, the non-linear conversion circuit 102 may be modified to include a number of non-linear tables $\mathbf{111}_1$–$\mathbf{111}_1$ different in their conversion characteristics and being connected in parallel to one another. The non-linear tables $\mathbf{111}_1$–$\mathbf{111}_n$ are connected at their input sides to adders $\mathbf{112}_1$–$\mathbf{112}_n$ which are arranged to add the tone-color control signals $TCNT_{11}$–$TCNT_{1n}$ respectively to the mixed waveform signal from subtractor 101 and to apply each resultant of the addition to the non-linear tables $\mathbf{111}_1$–$\mathbf{111}_n$. The non-linear table $\mathbf{111}_1$–$\mathbf{111}_n$ are connected at their output sides to multipliers $\mathbf{113}_1$–$\mathbf{113}_n$ which are arranged to multiply the tone color control signals $TCNT_{21}$–$TCNT_{2n}$ by each output of the non-linear tables $\mathbf{111}_1$–$\mathbf{111}_n$ and to apply each resultant of the multiplication to adders $\mathbf{114}_2$–$\mathbf{114}_n$. The adders $\mathbf{114}_2$–$\mathbf{114}_n$ act to mix the resultants of the multiplication and to issue the mixed resultant on the forward signal line L1. As a result, the waveform signal circulated through the excitation and signal transmission circuit portions 100 and 200 is varied in accordance with the tone-color control signals $TCNT_{11}$–$TCNT_{1n}$, $TCNT_{21}$–$TCNT_{2n}$. In the non-linear conversion circuit 102 of FIG. 4, the adders $\mathbf{114}_2$–$\mathbf{114}_n$ may be replaced with a multiplier, respectively as shown in FIG. 3. In a practical embodiment of the present invention, the adders $\mathbf{112}_1$, $\mathbf{112}_2$–$\mathbf{112}_n$ or the multipliers $\mathbf{113}_1$, $\mathbf{113}_2$–$\mathbf{113}_n$ may be eliminated in such a manner as to remain at least one of them. Alternatively, the adders $\mathbf{112}_1$, $\mathbf{112}_2$–$\mathbf{112}_n$ each may be replaced with other calculation means such as a multipliers $\mathbf{113}_1$, $\mathbf{113}_2$–$\mathbf{113}_n$ each may be also replaced subtractor, a multiplier or a divider, and the multipliers $\mathbf{113}_1$, $\mathbf{113}_2$–$\mathbf{113}_n$ each may be also replaced with other calculation means such as a divider, an adder or a subtractor.

Figure 5:
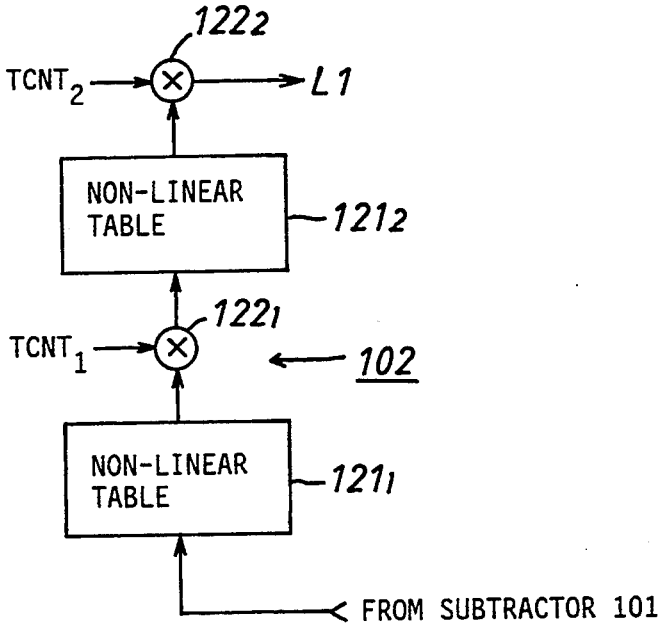

2) Series type of plural non-linear tables:

As shown in FIG. 5, a non-linear conversion circuit 102 of this type includes a first non-linear table $\mathbf{121}_1$ arranged to be applied with the mixed waveform signal from the subtractor 101 and a second non-linear table $\mathbf{121}_2$ connected in series with the first non-linear table $\mathbf{121}_1$ and having a conversion characteristic different from that of the first non-linear table $\mathbf{121}_1$. The non-linear tables $\mathbf{121}_1$, $\mathbf{121}_2$ are connected respectively at their output sides to multipliers $\mathbf{122}_1$, $\mathbf{122}_2$. The multiplier $\mathbf{122}_1$ is arranged to multiply a tone-color control signal $TCNT_1$ by an output signal from the first non-linear table $\mathbf{121}_1$ and to apply the resultant of the multiplication to the second non-linear table $\mathbf{121}_2$. The multiplier $\mathbf{122}_2$ is arranged to multiply a tone-color control signal $TCNT_2$ by an output signal from the second non-linear table $\mathbf{121}_2$ and to apply the resultant of the multiplication to the forward signal line L1.

Figure 6:
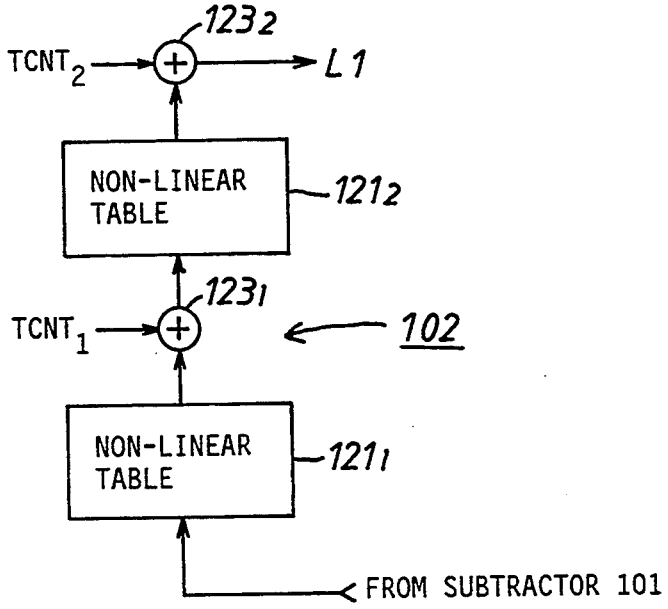

In operation, the waveform signal corresponding with the output signal of non-linear table $\mathbf{121}_1$ or $\mathbf{121}_2$ is varied in accordance with variation of either the tone-color control signal $TCNT_1$ or $TCNT_2$ applied to the multiplier $\mathbf{122}_1$ or $\mathbf{122}_2$. As a result, the waveform signal applied to the forward signal line L1 is varied in accordance with variation of the tone-color control signals $TCNT_1$, $TCNT_2$. This means that the non-linear conversion circuit 102 acts to non-linearly convert the mixed waveform signal from subtractor 101 in accordance with the tone-color control signals $TCNT_1$, $TCNT_2$ thereby to effect variation of the waveform signal circulating through the excitation and signal transmission circuit portions 100 and 200 in accordance with the tone-color control signals $TCNT_1$, $TCNT_2$. In a practical embodiment of the present invention, the multipliers $\mathbf{122}_1$, $\mathbf{122}_2$ of FIG. 5 may be replaced with adders $\mathbf{123}_1$, $\mathbf{123}_2$ as shown in FIG. 6. In such a modification, the waveform signal circulating through the excitation and signal transmission circuit portions 100 and 200 will be varied in accordance with the tone-color control signals $TCNT_1$, $TCNT_2$ in the same manner as described above.

Figure 7:
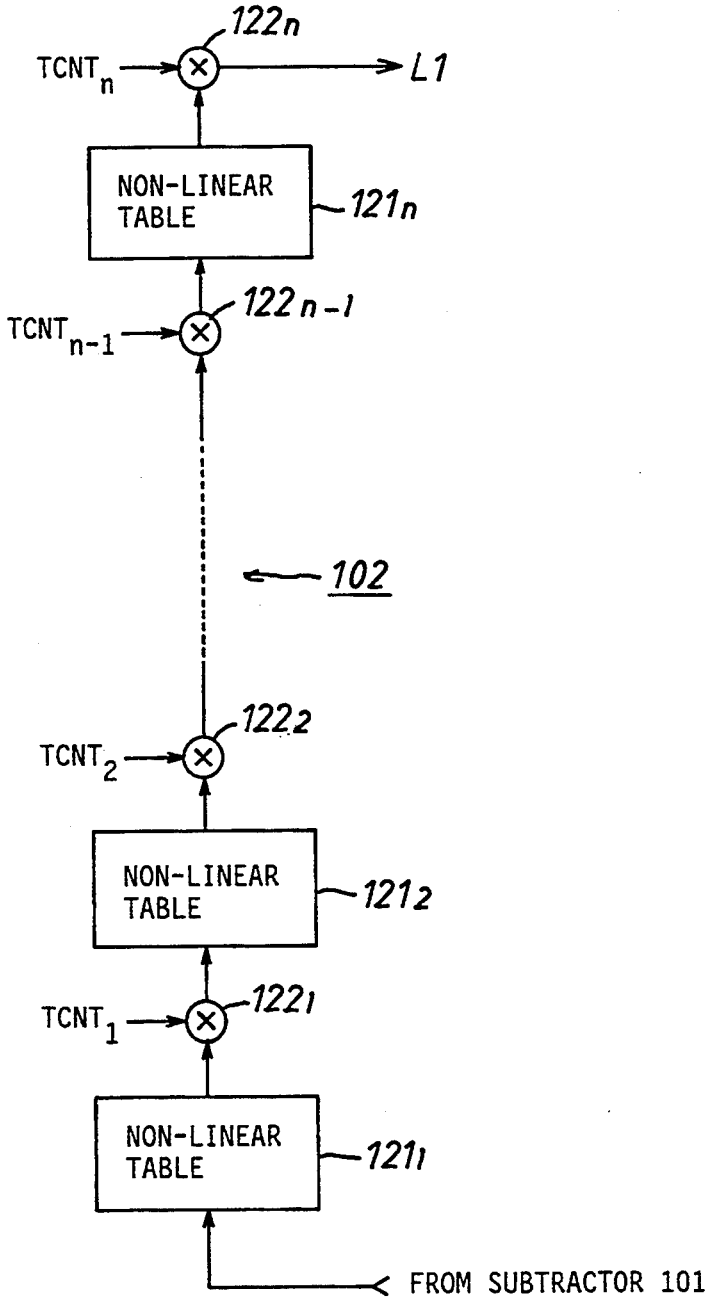

In FIG. 7 there is illustrated another modification of the non-linear conversion circuit 102 which includes a number of non-linear tables $\mathbf{121}_1$–$\mathbf{121}_n$ different in their conversion characteristics and being connected in series to one another. The non-linear tables $\mathbf{121}_1$–$\mathbf{121}_n$ are connected respectively at their output sides to multipliers $\mathbf{122}_1$–$\mathbf{122}_n$ which are arranged to vary output signals of non-linear tables $\mathbf{121}_1$–$\mathbf{121}_n$ in accordance with the tone-color control signals $TCNT_1$–$TCNT_n$ thereby to effect various conversion of the waveform signal circulating through the excitation and signal transmission circuit portions 100 and 200 in accordance with the tone-color control signals $TCNT_1$–$TCNT_{n-1}$. In this modification, the multipliers $\mathbf{122}_1$–$\mathbf{122}_n$ each may be also replaced with an adder.

Figure 8:
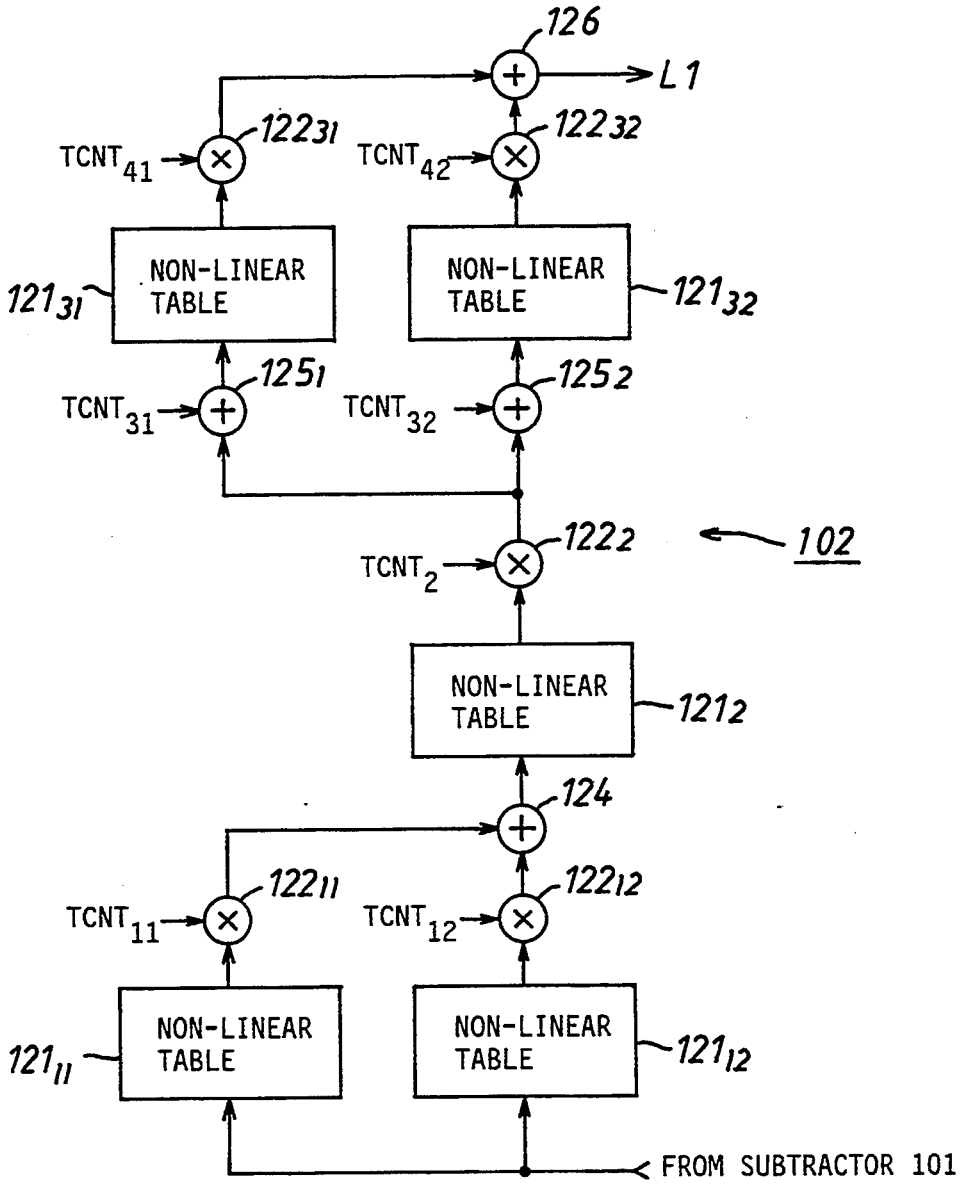

As shown in FIG. 8, the non-linear conversion circuit 102 of FIG. 7 may be composed of a plurality of non-linear tables $\mathbf{121}_{12}$, $\mathbf{121}_2$, $\mathbf{121}_{32}$ different in their conversion characteristics and being connected in series to one another and non-linear tables $\mathbf{122}_{11}$, $\mathbf{121}_{31}$ different in their conversion characteristics and being connected respectively in parallel with the non-linear tables $\mathbf{121}_{12}$, $\mathbf{121}_{32}$. The non-linear tables $\mathbf{121}_{11}$, $\mathbf{121}_{12}$ are connected respectively at their output sides to multipliers $\mathbf{122}_{11}$, $\mathbf{122}_{12}$ which are arranged to multiply tone-color control signals $TCNT_{11}$, $TCNT_{12}$ by output signals of non-linear tables $\mathbf{121}_{11}$, $\mathbf{121}_{12}$. The multipliers $\mathbf{122}_{11}$, $\mathbf{122}_{12}$ are connected to an adder 124 which is arranged to mix output signals of multipliers $\mathbf{121}_{11}$, $\mathbf{122}_{12}$ and to apply the mixed output signal to the non-linear table $\mathbf{121}_2$. The non-linear table $\mathbf{121}_{12}$ is connected at its output side to adders $\mathbf{125}_1$ and $\mathbf{125}_2$ through a multiplier $\mathbf{122}_2$. The multiplier $\mathbf{122}_2$ is arranged to multiply the tone-color control signal $TCNT_2$ by an output signal of non-linear table $\mathbf{121}_2$ and to apply the resultant of the multiplication to the adders $\mathbf{125}_1$, $\mathbf{125}_2$. The adder $\mathbf{125}_1$ is arranged to add the tone-color control signal $TCNT_{31}$ to the resultant of the multiplication and to apply the resultant of addition to the non-linear table $\mathbf{121}_{31}$, while the adder $\mathbf{125}_2$ is arranged to add the tone-color control signal $TCNT_{32}$ to the resultant of the multiplication and to apply the resultant of addition to the non-linear table $\mathbf{121}_{32}$.

The non-linear tables $\mathbf{121}_{31}$, $\mathbf{121}_{32}$ are connected respectively at their output sides to multipliers $\mathbf{122}_{31}$, $\mathbf{122}_{32}$ which are arranged to multiply the tone-color control signals $TCNT_{41}$, $TCNT_{42}$ by the output signals of non-linear tables $\mathbf{121}_{31}$, $\mathbf{121}_{32}$ and to apply the resultant of the multiplication to an adder 126 where the outputs of multipliers $\mathbf{122}_{31}$ and $\mathbf{122}_{32}$ are mixed and applied to the forward signal line L1. In operation, the multipliers $\mathbf{122}_{11}$, $\mathbf{122}_{12}$, $\mathbf{122}_2$, $\mathbf{122}_{31}$, $\mathbf{122}_{32}$ act to vary the output signals of non-linear tables $\mathbf{121}_{11}$, $\mathbf{121}_{12}$, $\mathbf{121}_2$, $\mathbf{121}_{31}$, $\mathbf{121}_{32}$ in accordance with the tone-color control signals $TCNT_{11}$, $TCNT_{12}$, $TCNT_2$, $TCNT_{41}$, $TCNT_{42}$, and the adders $\mathbf{125}_1$, $\mathbf{125}_2$, 126 act to vary the mixed output signal of multiplier $\mathbf{122}_1$ in accordance with the tone color control signals $TCNT_{31}$, $TCNT_{32}$. As a result, the waveform signal circulating through the excitation and signal transmission circuit portions 100 and 200 is varied in accordance with the tone-color control signals $TCNT_{11}$, $TCNT_{12}$, $TCNT_2$, $TCNT_{31}$, $TCNT_{32}$, $TCNT_{41}$, $TCNT_{42}$. In a practical embodiment of the present invention, the adders and multipliers shown in FIGS. 5–8 may be eliminted in such a manner as to remain at least one of them. Alternatively, the adders each may be replaced with a subtractor, a multiplier, a divider or other calculation means. Similarly, the multipliers each may be replaced with a divider, an adder, a subtractor or other calculation means.

Figure 9:
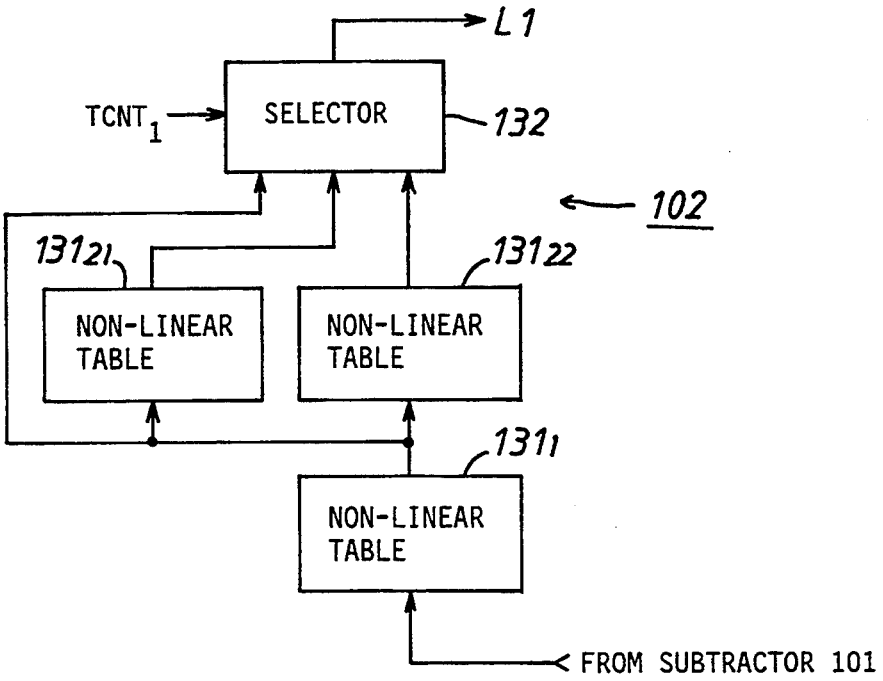

3) Selective combination type of plural non-linear tables:

As shown in FIG. 9, a non-linear conversion circuit 102 of this type includes a first non-linear table $\mathbf{131}_1$ arranged to be applied with the mixed waveform signals from subtractor 101, non-linear tables $\mathbf{131}_{21}$, $\mathbf{131}_{22}$ different in their conversion characteristics and being respectively connected in series with the first non-linear table $\mathbf{131}_1$, and a selector 132 connected at its input side to the non-linear tables $\mathbf{131}_1$, $\mathbf{131}_{21}$, $\mathbf{131}_{22}$ to selectively apply either one of the output signals of non-linear tables $\mathbf{131}_1$, $\mathbf{131}_{21}$, $\mathbf{131}_{22}$ to the forward signal line L1 in response to the tone-color control signal $TCNT_1$. Assuming that the output signal of non-linear table $\mathbf{131}_1$ has been selected by the selector 132 in response to the tone-color control signal $TCNT_1$, the mixed waveform signal from subtractor 101 is non-linearly converted in dependence upon the conversion characteristic of non-linear table $\mathbf{131}_1$ to be applied to the forward signal line $L_1$. When the output signal of non-linear table $\mathbf{131}_{21}$ is selected by the selector 132 in response to the tone-color control signal $TCNT_1$, the mixed waveform signal from subtractor 101 is non-linearly converted in dependence upon the conversion characteristics of non-linear tables $\mathbf{131}_1$ and $\mathbf{131}_{21}$ to be applied to the forward signal line L1. When the output signal of non-linear table $\mathbf{131}_{22}$ is selected by the selector 132 in response to the tone-color control signal $TCNT_1$, the mixed waveform signal from subtractor 101 is non-linearly converted in dependence upon the conversion characteristics of non-linear tables $\mathbf{131}_1$ and $\mathbf{131}_{22}$ to be applied to the forward signal line L1. As a result, the non-linear conversion circuit 102 acts to effect various conversion of the waveform signal circulating through the excitation and signal transmission circuit portions 100 and 200 in accordance with the tone-color control signal $TCNT_1$ applied thereto.

Figure 10:
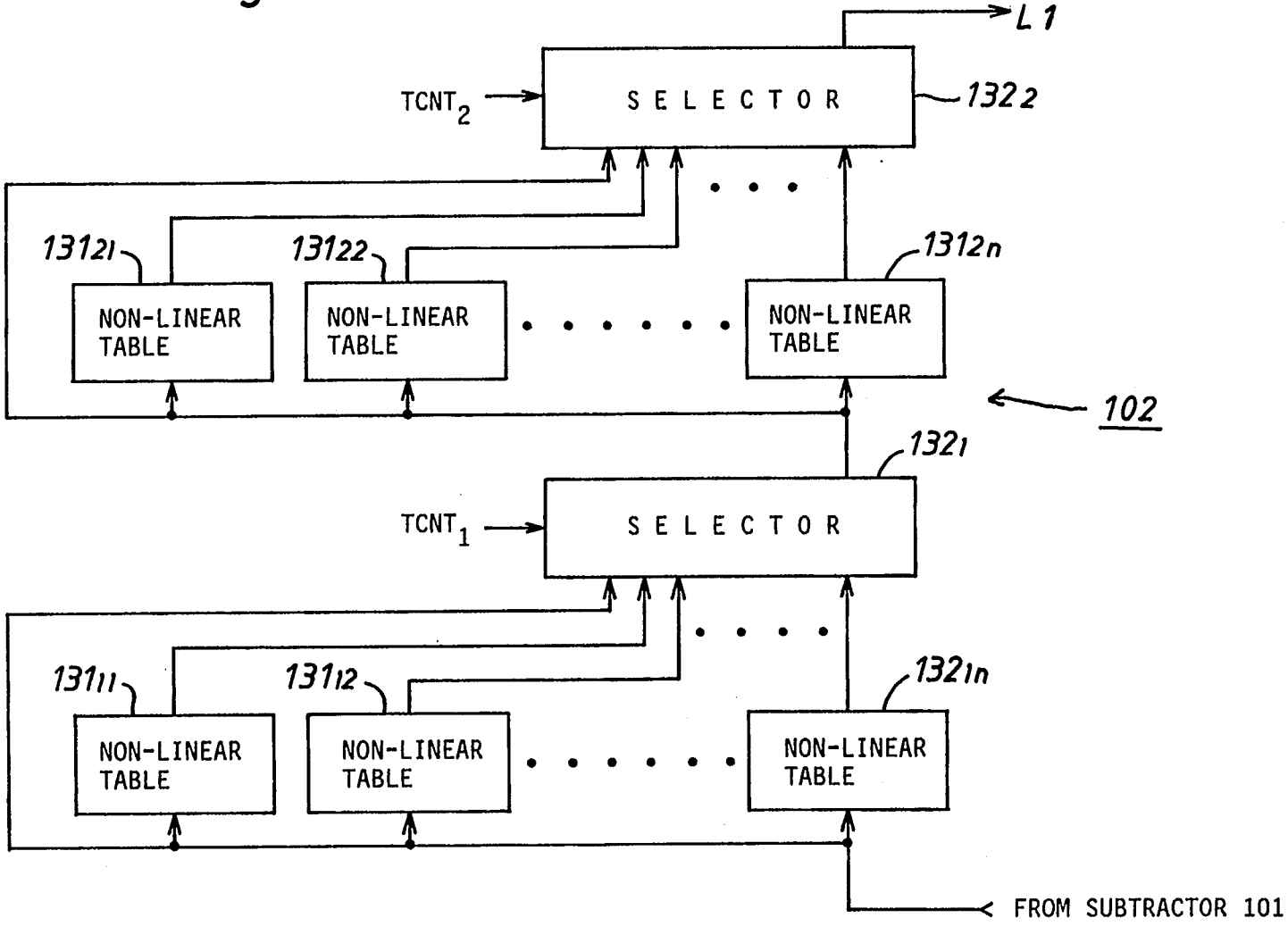

The non-linear conversion circuit 102 of this type may be modified as shown in FIG. 10, wherein a plurality of non-linear tables $\mathbf{131}_{11}$–$\mathbf{131}_{1n}$ different in their conversion characteristics are connected in parallel to one another to be applied with the mixed waveform signal from subtractor 101. The non-linear tables $\mathbf{131}_{11}$–$\mathbf{131}_{1n}$ are connected at their output sides to a first selector $\mathbf{132}_1$ which is arranged to be applied with the mixed waveform signal from subtractor 101. The first selector $\mathbf{132}_1$ acts to select the mixed waveform signal from subtractor 101 or one of output signals of non-linear tables $\mathbf{131}_{11}$–$\mathbf{131}_{1n}$ in response to the tone-color control signal $TCNT_1$. The first selector $\mathbf{132}_1$ is connected at its output side to a plurality of non-linear tables $\mathbf{131}_{21}$–$\mathbf{131}_{2n}$ which are different in their conversion characteristics and connected in parallel to one another. The non-linear tables $\mathbf{131}_{21}$–$\mathbf{131}_{2n}$ are connected at their output sides to a second selector $\mathbf{132}_2$ which is arranged to be applied with an output signal of the first selector $\mathbf{132}_1$. The second selector $\mathbf{132}_2$ acts to select the output signal of first selector $\mathbf{132}_1$ or one of output signals of the non-linear tables $\mathbf{131}_{21}$–$\mathbf{131}_{2n}$ in response to the tone-color control signal $TCNT_2$ and to apply the selected output signal to the forward signal line L1. In operation, the selectors $\mathbf{132}_1$ and $\mathbf{132}_2$ act to variously combine the conversion characteristics of non-linear tables $\mathbf{131}_{11}$–$\mathbf{131}_{1n}$ and $\mathbf{131}_{21}$–$\mathbf{131}_{2n}$ in accordance with the tone-color control signals $TCNT_1$ and $TCNT_2$. As a result, the waveform signal circulating through the excitation and signal transmission circuit portions 100 and 200 is variously varied in accordance with the tone-color control signals $TCNT_1$ and $TCNT_2$ applied to the selectors $132_1$ and $132_2$.

Figure 11:
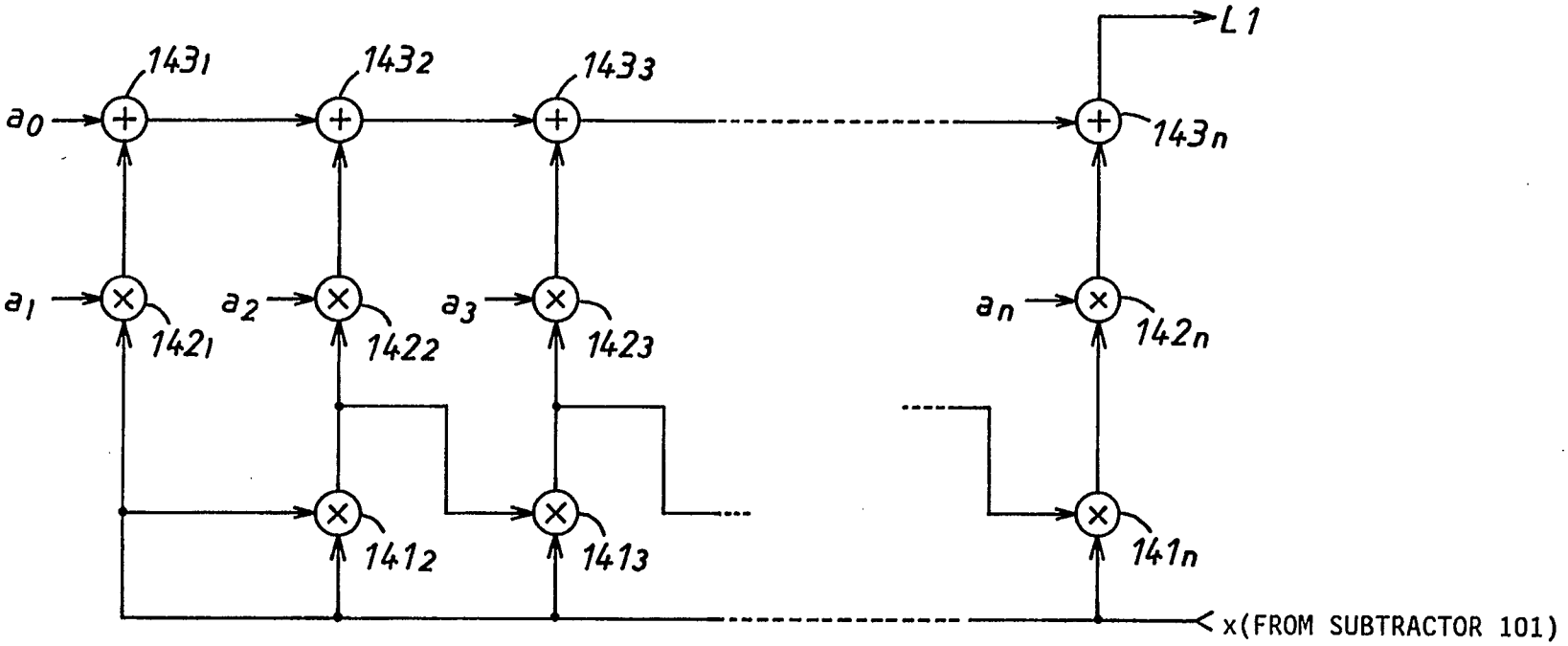

4) Mathematical sum of series calculation type:

As shown in FIG. 11, a non-linear conversion circuit 102 of this type is designed to effect non-linear conversion of the mixed waveform signal from subtractor 101 by mathematical sum of series calculation under control of the tone-color control signal applied thereto. The non-linear conversion circuit 102 includes a first series of multipliers $141_2$–$141_n$ for progressively multiplying a value x of the mixed waveform signal to a required power or degree, a second series of multipliers $142_1$–$142_n$ for multiplying the value x of the mixed waveform signal and the progressively multiplied values $x^2, x^3 \ldots x^n$ by coefficients $a_1, a_2 \ldots a^n$ respectively, and a series of adders $143_1$–$143_n$ for progressively adding the resultants of the multiplication applied thereto from multipliers $142_1$–$142_n$ as described below.

$$a_0+a_1x+a_2x^2+\ldots+a_nx^n$$

where the coefficients $a_0, a_1, a_2 \ldots a_n$ are determined to correspond with the tone-color control signals $TCNT_x$.

In the non-linear conversion circuit 102, the value x of the mixed waveform signal can be changed to an appropriate value by variation of the coefficients $a_0, a_1, a_2 \ldots a_n$ to effect various non-linear conversion of the mixed waveform signal. As a result, the waveform signal circulating through the excitation and signal transmission circuit portions 100 and 200 is variously varied in accordance with the tone-color control signals $TCNT_X$.

Figure 12:
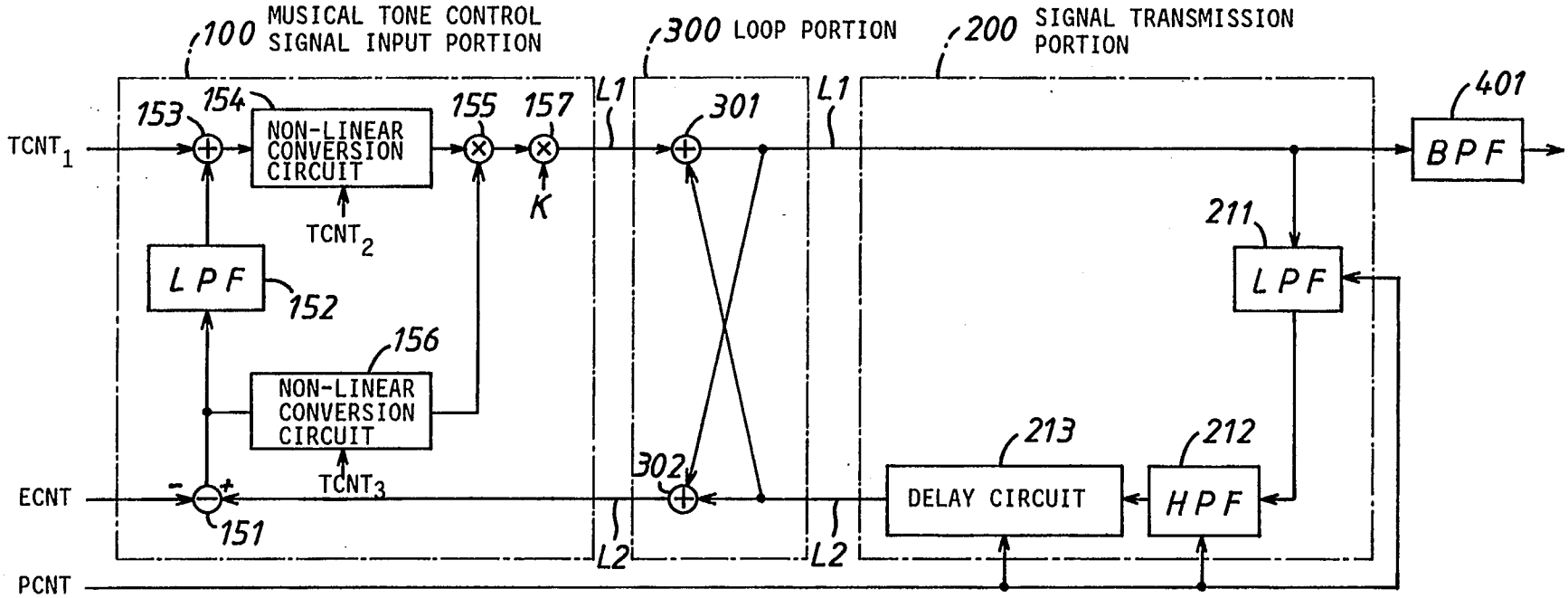
FIG. 12 is a block diagram of a preferred embodiment of a musical tone waveform signal generating apparatus suitable for generating a wind instrument tone signal.

Hereinafter, preferred embodiments of the fundamental music tone waveform signal generating apparatus will be described.

a) In FIG. 12 there is illustrated a musical tone waveform signal generating apparatus suitable for generating a musical tone waveform signal indicative of a musical tone of a wind instrument such as a clarinet, a saxophone or the like. The musical tone waveform signal generating apparatus includes an excitation circuit portion 100 and a signal transmission circuit portion 200 as well as the fundamental musical tone waveform generating apparatus and further includes a loop circuit portion 300 provided between the excitation and signal transmission circuit portions 100 and 200. The excitation circuit portion 100 has a subtractor 151 which is arranged to subtract the excitation signal ECNT from the waveform signal fed back thereto through the backward signal line L2. In the case that the musical tone waveform signal generating apparatus is adapted to the mouth-piece of a wind instrument shown in FIG. 13, the fed back waveform signal corresponds with a pressure Q of oscillation wave fed back to the mouth-piece from the resonance tube of the wind instrument, and the excitation signal ECNT corresponds with an internal pressure of the performer's mouth. Thus, the output signal of subtractor 151 represents a pressure difference by which the reed 41 of the mouth-piece 41 is varied in shape.

The subtractor 151 is connected at its output side to a low-pass filter 151 which is provided to eliminate high-frequency component from the output signal indicative of the pressure difference. The low-pass filter 152 is connected at its output side to an adder 153 which is arranged to add the tone-color control signal $TCNT_1$ to the output of low-pass filter 152 and apply it to a non-linear conversion circuit 154. In this case, the tone-color control signal $TCNT_1$ corresponds with an Embouchure signal indicative of the opening shape and holding pressure of the performer's lip which holds the mouth-piece of the wind instrument. The non-linear conversion circuit 154 is arranged to have an input-output characteristic shown in FIG. 13 thereby to simulate displacement of the reed 42 caused by an air pressure applied thereto. Thus, the output of non-linear conversion circuit 154 represents an air passage area at the reed 42 of mouth-piece 41. Preferably, the non-linear conversion circuit 154 is constructed as shown in FIGS. 2 to 11 to cause variation of its input-output characteristic in accordance with the tone-color control signal $TCNT_2$ applied thereto. The non-linear conversion circuit 154 is connected at its output side to a multiplier 155 which is arranged to be applied with the pressure difference signal from subtractor 151 through a non-linear conversion circuit 156.

Figure 15:
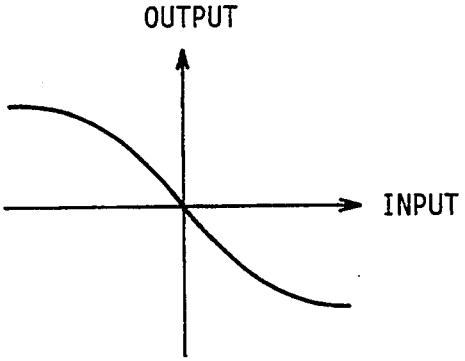

The non-linear conversion circuit 156 is arranged to simulate the fact that the pressure difference is not proportional to the velocity of air-flow which is saturated at the narrow tube passage even if the pressure difference becomes large. For such an arrangement, the non-linear conversion circuit 156 is designed to have an input-output characteristic shown in FIG. 15. Preferably, the non-linear conversion circuit 156 is constructed as shown in FIGS. 2 to 11 to cause variation of its input-output characteristic in accordance with the tone-color control signal $TCNT_3$ applied thereto. Thus, the non-linear conversion circuit 156 acts to compensate the pressure difference signal from subtractor 151 in consideration with affects of the pressure difference at the reed 42 of mouth-piece 41 to the velocity of air-flow and to apply the compensated pressure difference signal to the multiplier 155. The multiplier 155 acts to multiply the signal indicative of the air-passage area at the reed 42 by the compensated pressure difference singal from non-linear conversion circuit 156 and to issue the multiplied signals as a signal indicative of the velocity of air-flow at the reed 42 of mouth-piece 41. The mulitiplier 155 is connected at its output side to a multiplier 157 which is arranged to multiply the signal indicative of the velocity of air-flow by a fixed coefficient K indicative of the impedance or resistance of air in the mouth-piece 41 and to apply the resultant of multiplication as a tone pressure signal to the loop circuit portion 300 through the forward signal line L1.

The signal transmission circuit portion 200 includes a low-pass filter 211, a high-pass filter 212 and a delay circuit 213 provided on the backward signal line L2. At the low and high-pass filters 211 and 212, a cut-off frequency of filters 211,212 is variously controlled in accordance with the pitch control signal PCNT. In this case, the high-pass filter 213 may be eliminated, and the delay circuit 213 is desinged as similar to the fundamental delay circuit shown in FIG. 1. A band-pass 401 is connected to the forward signal line L1 to simulate the radiation characteristic of the musical tone in the air and to issue therethrough the musical tone waveform signal.

Figure 13:
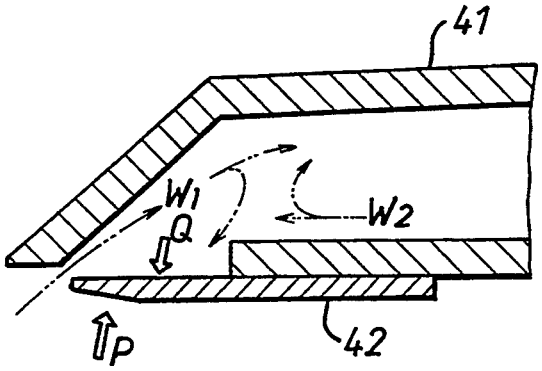
FIG. 13 is a schematic illustration of the mouth-piece of a wind instrument.
Figure 14:
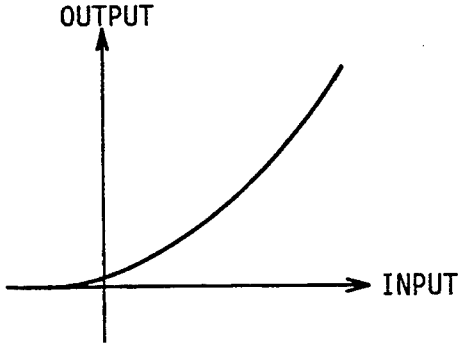
FIGS. 14 and 15 are graphs showing basic conversion characteristics of non-linear conversion circuits shown in FIG. 12.

The loop circuit portion 300 includes adders 301 and 302 which are provided respectively on the forward and backward singal lines L1 and L2. The adder 301 is arranged to add the waveform signal from multiplier 157 to the waveform signal from delay circuit 213 thereby to apply the resultant of addition to the forward signal line L1. The adder 302 is arranged to add the waveform signal from signal line L1 to the waveform signal from delay circuit 213 thereby to apply the resultant of addition to the backward signal line L2. With such an arrangement of adders 301 and 302, as shown in FIG. 13, an incident wave $W_1$ caused by the velocity of input flow immediately after the gap between mouth-piece 41 and reed 42 is mixed with a reflected wave $W_2$ from the resonance tube of the wind instrument to simulate the occurrence of pressure in the resonance tube.

Figure 16:
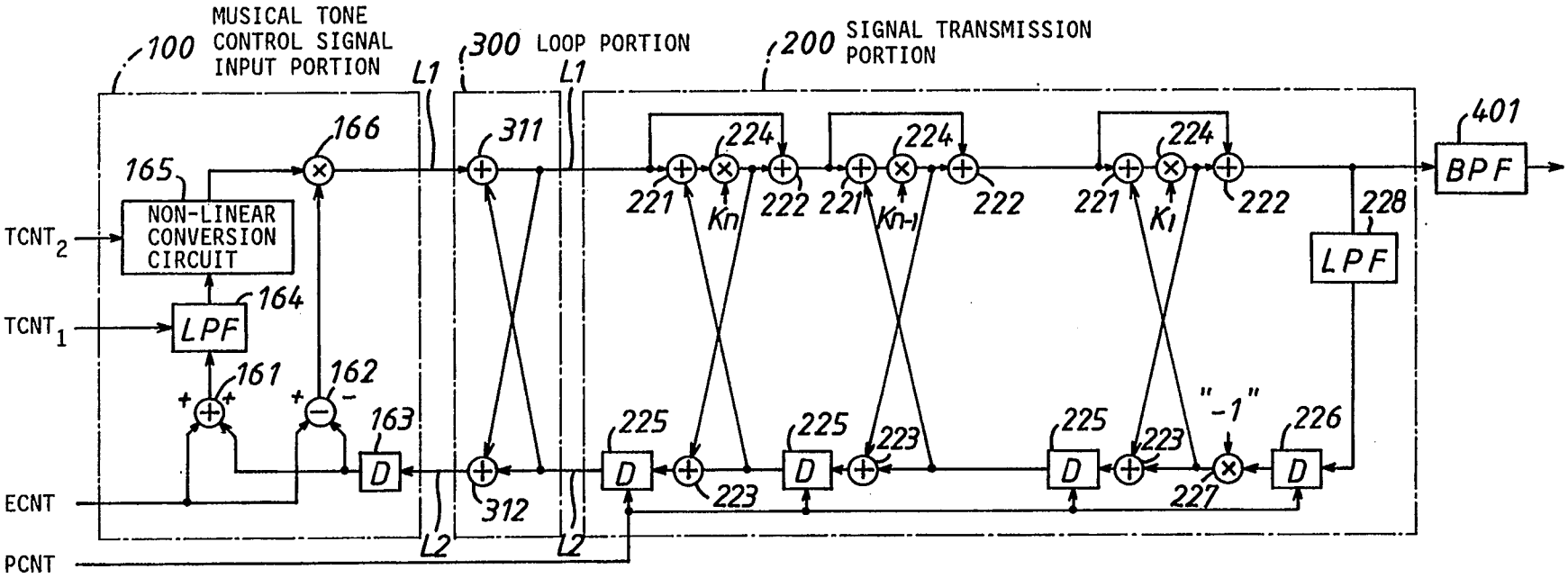
FIG. 16 is a block diagarm of a preferred embodiment of a musical tone waveform signal generating apparatus suitable for generating a brass-wind instrument tone signal.

In operation of the musical tone waveform signal generating apparatus described above, a waveform signal is excited on the signal lines L1, L2 under control of the excitation control signal ECNT and subtractor 151 and is circulated through the signal lines L1, L2. At the excitation circuit portion 100, the function of mouth-piece 41 and reed 42 is simulated under control of the tone-color control signal $TCNT_1$ indicative of Embouchure and non-linear conversion circuits 154, 156. As a result, the excitation control of the waveform signal is more concretely carried out. The excited waveform signal is applied to the loop circuit portion 300 and signal transmission circuit portion 200. At the loop circuit portion 300, a condition of the incident wave $W_1$ and reflected wave $W_2$ is simulated. At the signal transmission circuit portion 200, a pitch of a musical tone to be generated is determined by the delay circuit 213, and a condition of an acoustic waveform signal in the resonance tube is simultaed under control of the low and high-pass fliters 211 and 212. Since a musical tone of the wind instrument such as the clarinet, saxophone or the like is more concretely simulated in such a manner as described above, an artificial musical tone similar to the sound of the wind instrument is obtainable. In the musical tone waveform signal generating apparatus, the non-linear conversion circuits 154 and 156 are constructed as shown in FIGS. 2 to 11 in such a manner that the conversion characteristics of circuits 154 and 156 are variously controlled in accordance with the tone-color control signals $TCNT_2$ and $TCNT_3$. This is effective to generate various wind instrument tones of high quality.

b) In FIG. 16 there is illustrated a musical tone waveform signal generating apparatus suitable for generating a musical tone signal of a brass-wind instrument. Similar to the musical tone waveform signal generating apparatus of FIG. 12, the apparatus includes an excitation circuit portion 100, a signal transmission circuit portion 200 and a loop circuit portion 300. In this case, the musical tone control signal generating portion 30 shown in FIG. 1 is arranged to issue a pitch control signal PCNT corresponding with a frequency of a musical tone to be generated, an excitation control signal ECNT indicative of an internal pressure of the performer's mouth and tone-color control signals $TCNT_1$, $TCNT_2$. The excitation circuit portion 100 includes an adder 161 and a subtractor 162. The adder 161 is arranged to add the excitation control signal ECNT to a slightly delayed waveform signal applied thereto from a delay circuit 163 through backward signal line L2 thereby to issue a signal indicative of a pressure opening the performer's lip. The adder 161 is connected at its output side to a low-pass filter 164 which eliminates a high frequency component from the output signal of adder 161.

Figure 17:
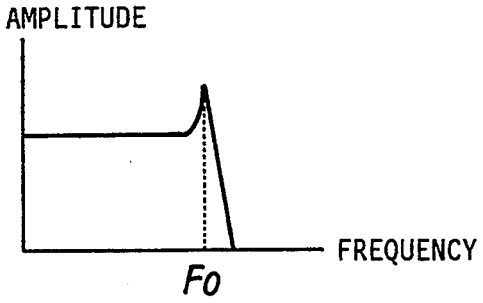
FIG. 17 is a graph showing a frequency characteristic of a low-pass filter shown in FIG. 16.
Figure 18:
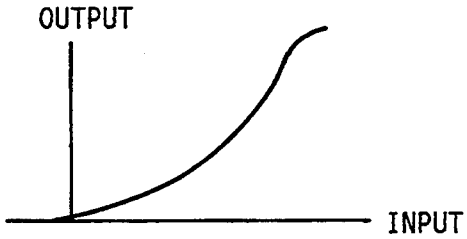
FIG. 18 is a graph showing a basic conversion characteristic of a non-linear conversion circuit shown in FIG. 16.

The low-pass filter 164 is arranged to be controlled in its cut-off and resonance frequency in accordance with the tone-color control signal $TCNT_1$ applied thereto. (see FIG. 17) Such arrangement of the low-pass filter 164 is effective to simulate the fact that the frequency of musical tone is controlled by firmness of the performer's lip to the mouth-piece of the wind instrument. Thus, the low-pass filter 164 acts to control the oscillation frequency of the waveform signal with delay of time for controlling the frequency of the musical tone. The low-pass filter 164 is connected at its output side to a non-linear conversion circuit 165 which is constructed as shown in FIGS. 2 to 11 to be controlled by the tone-color control signal $TCNT_2$. The non-linear conversion circuit 165 has an input-output characteristic shown in FIG. 18 and acts to simulate the opening condition of the performer's lip against the pressure opening his lip. Thus, the non-linear conversion circuit 165 issues an output signal indicative of the opening area of the performer's lip and applies it to a multiplier 166. The multiplier 166 is further connected at its input side to the subtractor 162 which is arranged to subtract the waveform signal from the excitation control signal ECNT thereby to apply a signal indicative of a difference in pressure at the front and back sides of the performer's lip to the multiplier 166. Thus, the multiplier 166 acts to multiply the signal indicative of the difference in pressure by the signal indicative of the the opening area of the performer's lip thereby to apply the resultant of multiplication as a signal indicative of the velocity of air-flow to the loop circuit portion 300 through the forward signal line L1. As a result, the loop circuit portion 300 is applied with a waveform signal indicative of a sound wave at the mouth-piece of the brass-wind instrument. The loop circuit portion 300 includes adders 311 and 312 which are arranged to simulate the condition of air-flow in the mouth-piece of the wind instrument in such a manner as described above.

The signal transmission circuit portion 200 includes n-stages of ladder circuits each composed of adders 221 to 223 arranged to successively add the waveform signals applied thereto, a multiplier 224 arranged to multiply the waveform signal by fixed coefficient K ($=K_n$, $K_{n-1}$, . . . $K_1$) and a delay circuit 225 arranged to delay the waveform signal. The signal transmission circuit portion 200 further includes a cascade circuit of the Kelly-Lochbaum type composed of a delay circuit 226 arranged to delay the waveform signal and a multiplier 227 arranged to multiply the waveform signal by fixed coefficient "−1". The cascade circuit is normally used for voice synthesis since it is well designed to simulate propagation of the sound wave in the cylindrical tube. In this case, each delay time of delay circuits 225, 226 is controlled by the pitch control signal PCNT such that the sum of delay times corresponds to the frequency of the musical tone to be generated. The cascade circuit is provided at its one portion with a low-pass filter 228 which is connected at its input side to a band-pass filter 401 arranged to issue the waveform signal therethrough. The musical tone waveform signal generating apparauts as desecribed above operates as well as the apparatus of FIG. 12 to more concretely simulate generating and transmitting conditions of a sound waveform signal in a brass-wind instrument. Thus, a musical tone similar to an actual brass-wind instrument is obtainable. In this case, the musical tone waveform signal is variously controlled in accordance with the tone color control signals $TCNT_1$, $TCNT_2$.

Figure 19:
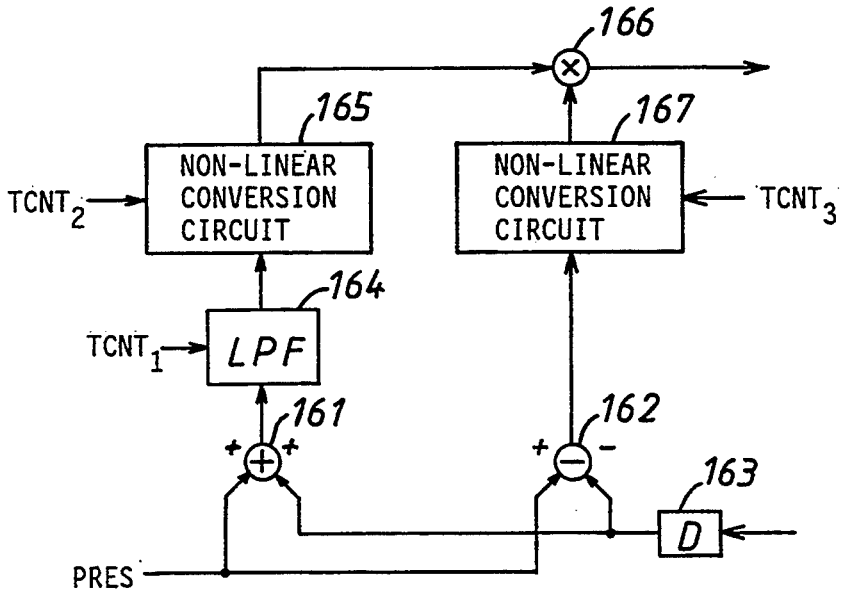
FIG. 19 is a block diagram of a modification of an excitation circuit portion shown in FIG. 16.
Figure 20:
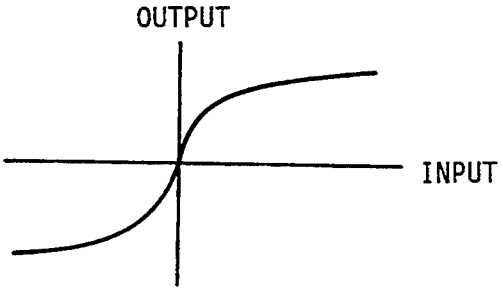
FIG. 20 is a graph showing a basic conversion characteristic of a non-linear conversion circuit shown in FIG. 19.
Figure 21:
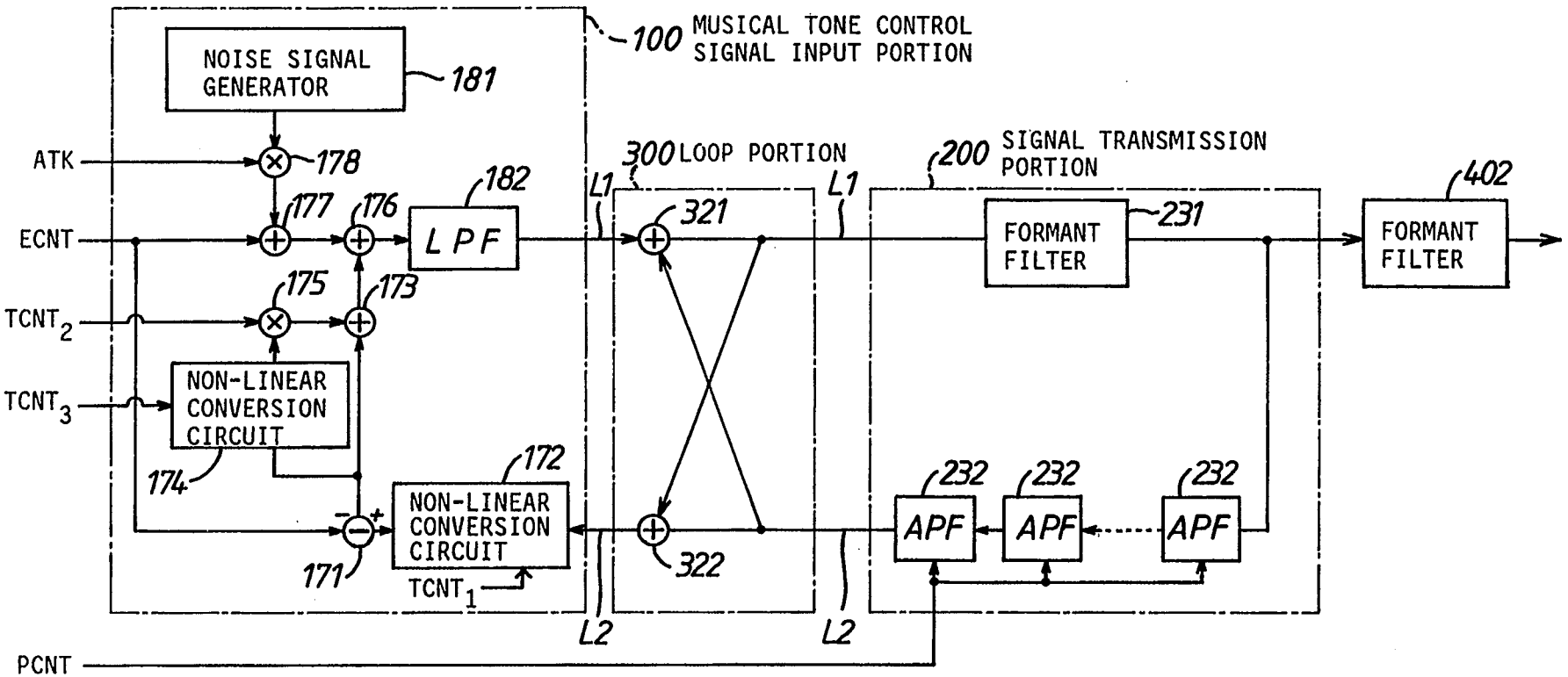
FIG. 21 is a block diagram of a preferred embodiment of a musical tone waveform signal generating apparatus suitable for generating a novel musical tone signal.
Figure 22:
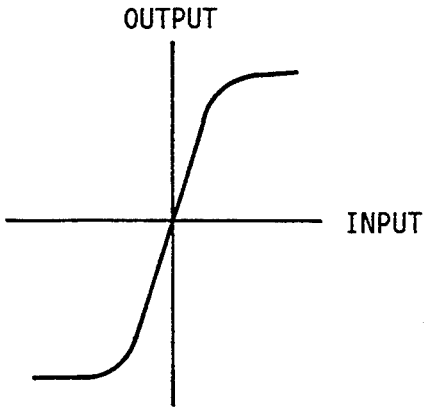
FIGS. 22 and 23 are graphs showing basic conversion characteristics of non-linear conversion circuits shown in FIG. 21.

In FIG. 19, there is illustrated a modification of the musical tone waveform signal generating apparatus wherein a non-linear conversion circuit 167 is provided between the subtractor 162 and multiplier 166. The non-linear conversion circuit 167 is constructed as shown in FIGS. 2 to 11 to simulate saturation of the air-flow velocity. Basically, the non-linear conversion circuit 167 has an input-output characteristic shown in FIG. 20, which is varied in accordance with the tone color control signal $TCNT_3$. With such an arrangement of the non-linear conversion circuit 167, the air-flow is more accurately taken into account of the resultant of multiplication at the multiplier 166. Thus, the air-flow in the mouth-piece of the brass-wind instrument is more accurately simulated to effect formation of a musical tone signal more similar to the actual sound of brass-wind instrument.

c) In FIG. 21 there is illustrated a musical tone waveform signal generating apparatus suitable for synthesizing a musical tone waveform signal. Simlarly to the apparatus of FIG. 12 or FIG. 16, the musical tone waveform signal generating apparatus includes an excitation circuit portion 100, a signal transmission circuit portion 200 and a loop circuit portion 300. In this case, the musical tone control signal generating portion 30 shown in FIG. 1 is coupled with the excitation circuit portion 100 to provide a pitch control signal PCNT corresponding with a frequency of a musical tone to be generated, an excitation control signal ECNT indicative of an internal pressure of the performer's mouth and tone-color control singals $TCNT_1$, $TCNT_2$ and $TCNT_3$ and to further provide an attack signal ATK which is produced only at a leading edge of the musical tone signal. The excitation circuit portion 100 includes a subtractor 171 which corresponds with the subtractor 101 shown in FIG. 1 and is arranged to subtract the excitation control signal ECNT from a waveform signal applied thereto from a backward signal line L2 through a non-linear conversion circuit 172. The non-linear conversion circuit 172 has an input-output characteristic shown in FIG. 22 and is constructed as shown in FIGS. 2 to 11 to be controlled by the tone-color control signal $TCNT_1$. Thus, the non-linear conversion circuit 172 acts as a limiter to prevent enlargement of the amplitude of the waveform signal fed back through signal line L2.

Figure 23:
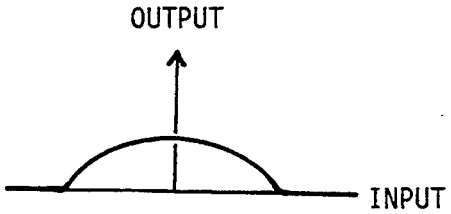
Figure 24:
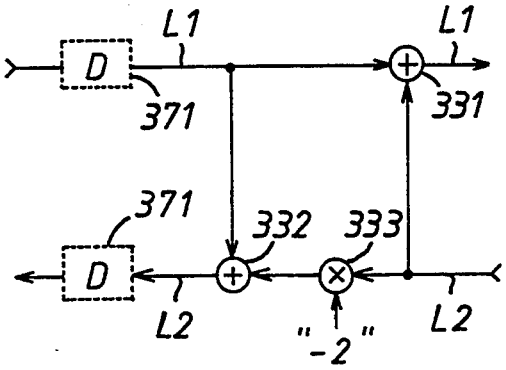
FIGS. 24 to 27 are block diagrams of modifications of loop circuit portions respectively shown in FIGS. 12, 16 and 21.
Figure 25:
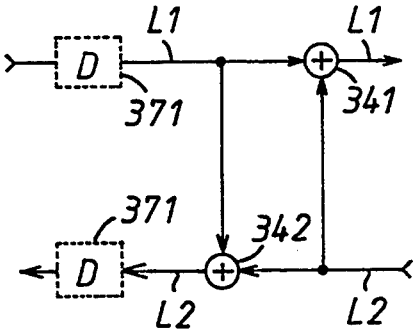

With such an arrangement of the non-linear conversion circuit 172, a gain of a loop composed of the signal lines L1 and L2 is restrained to effect stable oscillation for generation of a musical tone signal. An output of subtractor 171 is applied to an adder 173 and to a multiplier 175 through a non-linear conversion circuit 174 to be multiplied by the tone-color control signal $TCNT_2$. The multiplied signal is applied to the adder 173 to be added to the output of subtractor 171. As shown in FIG. 23, an input-output characteristic of non-linear conversion circuit 174 is determined in such a manner that the output of subtractor 171 is converted into a relatively large value in its small amplitude region and that the amplitude of the output is converted into zero in a large region. In this apparatus, the non-linear conversion circuit 174 is constructed as shown in FIGS. 2 to 11 to be controlled by the tone-color control signal $TCNT_3$ in its characteristic. When the output of subtractor 171 is large in its amplitude, it will be issued from the adder 173 to cause stable oscillation of the waveform signal circulating through signal lines L1 and L2. When the output of subtractor 171 becomes small in its amplitude, it will be amplified at the non-linear conversion circuit 174 and multiplied by the tone-color control signal $TCNT_2$ to be issued from the adder 173. In this instance, oscillation of the waveform singal circulating through signal lines L1 and L2 is maintained under control of the non-linear conversion circuit 174 and is controlled by the tone-color control signal $TCNT_2$.

The adder 173 is connected at its output side to an adder 176 connected at its input side to an adder 177. A multiplier 178 is arranged to multiply the attack signal ATK by a noise signal applied thereto from a noise signal generator 181. Thus, the adder 177 acts to add the excitation control signal ECNT to the multiplied noise signal and apply the mixed signal in addition to the adder 176. With such an arrangement of the adder 176, the waveform signal on signal lines L1 and L2 is added to the excitation control signal ECNT and the noise signal which varies irregularly in its amplitude value at an initial stage. The output of adder 176 is applied to the forward signal line L1 through a low-pass filter 182 to be supplied to the loop circuit portion 300.

The loop circuit portion 300 includes adders 321 and 322 arranged to simulate transmission and reflection of the waveform signal as described above. The signal transmission circuit portion 200 includes a formant filter 231 and all-pass filters 232 respectively provided on signal lines L1 and L2. The formant filter 231 is designed to apply a desired frequency characteristic, corresponding to an acoustic transmission characteristic of a resonance tube, to the waveform signal. The phase characteristic of all-pass filters 232 is varied in accordance with the pitch control signal PCNT so that the sum of phase delays of the waveform signal caused by filters 232 corresponds with the frequency of a musical tone to be generated and that the resonant frequency of the musical tone waveform signal on the circultation signal lines corresponds with the pitch of the musical tone to be generated. The formant filter 231 is connected at its output side to another formant filter 402 which is arranged to issue therefrom the waveform signal on the signal lines L1 and L2.

In operation of the musical tone waveform signal generating apparatus described above, the input signal applied to the forward signal line L1 and the waveform signal fed back through the backward signal line L2 are variously controlled in accordance with the control signals ECNT, ATK, $TCNT_1$–$TCNT_3$ applied to the excitation circuit portion 100. This is effective to variously control the formation of the waveform signal.

d) In FIGS. 24 to 27, there are illustrated modifications of the loop circuit portion 300 in the musical tone waveform signal generating apparatuses shown in FIGS. 12, 16 and 21. In the loop circuit portion 300 shown in FIG. 24, an adder 331 is provided to add the waveform signal from signal line L2 to the waveform signal from signal line L1 thereby to apply the resultant of addition to the signal transmission circuit portion 200 through signal line L1. An adder 332 is further provided to add the waveform signal from signal line L1 to the waveform signal applied thereto from signal line L2 through an adder 333 thereby to apply the resultant of addition to the excitation circuit portion 100. In this case, the adder 333 is arranged to make the waveform signal from signal line L2 two times. In the loop circuit portion shown in FIG. 25, an adder 341 is provided to add the waveform signal from signal line L2 to the waveform signal applied thereto from the excitation circuit portion 100 through signal line L1 thereby to apply the resultant of addition to the signal transmission circuit portion 200 through signal line L1. An adder is further provided to add the waveform signal from signal line L2 to the waveform signal from signal line L1 to apply the resultant of addition to the excitation circuit portion 100 through signal line L2.

Figure 26:
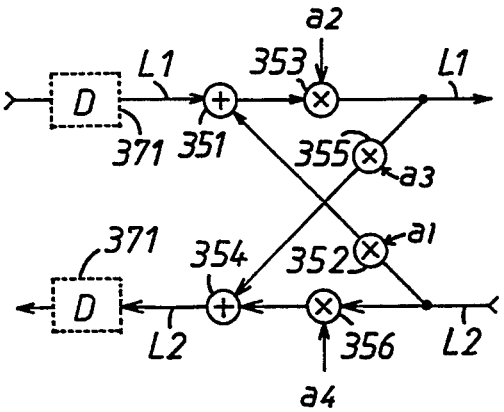

In the loop circuit portion 300 shown in FIG. 26, an adder 351 is provided to add the waveform signal from signal line L1 to the waveform signal applied thereto from signal line L2 through a multiplier 352 where the waveform signal from signal line L2 is multiplied by a coefficient $a_1$. A multiplier 353 is arranged to multiply the resultant of addition at adder 351 by a coefficient $a_2$ and to apply the resultant of multiplication to the signal transmission circuit portion 200 through signal line L1. An adder 354 is arranged to add the waveform signal multiplied by a coefficient $a_3$ at a multiplier 355 to the waveform signal multiplied by a coefficient $a_4$ at a multiplier 356 and to apply the resultant of addition to the excitation circuit portion 100 through the backward signal line L2. In this case, the coefficients $a_1$–$a_4$ may be fixed or replaced with the tone-color control signal TCNT variably deteremined at the musical tone control signal generating portion 30.

Figure 27:
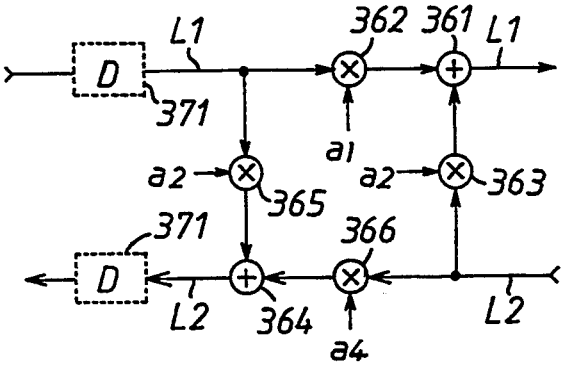

In the loop circuit portion 300 shown in FIG. 27, an adder 361 is provided to add the waveform signal multiplied by a coefficient $a_1$ at a multiplier 362 to the waveform signal multiplied by a coefficient $a_2$ at a multiplier 363 and to apply the resultant of addition to the signal transmission circuit portion 200 through signal line L1. An adder 364 is arranged to add the waveform signal multiplied by a coefficient $a_3$ at a multiplier 365 to the waveform signal multiplied by a coefficient $a_4$ at a multiplier 366 and to apply the resultant of addition to the excitation circuit portion 100 through signal line L2.

Figure 28:
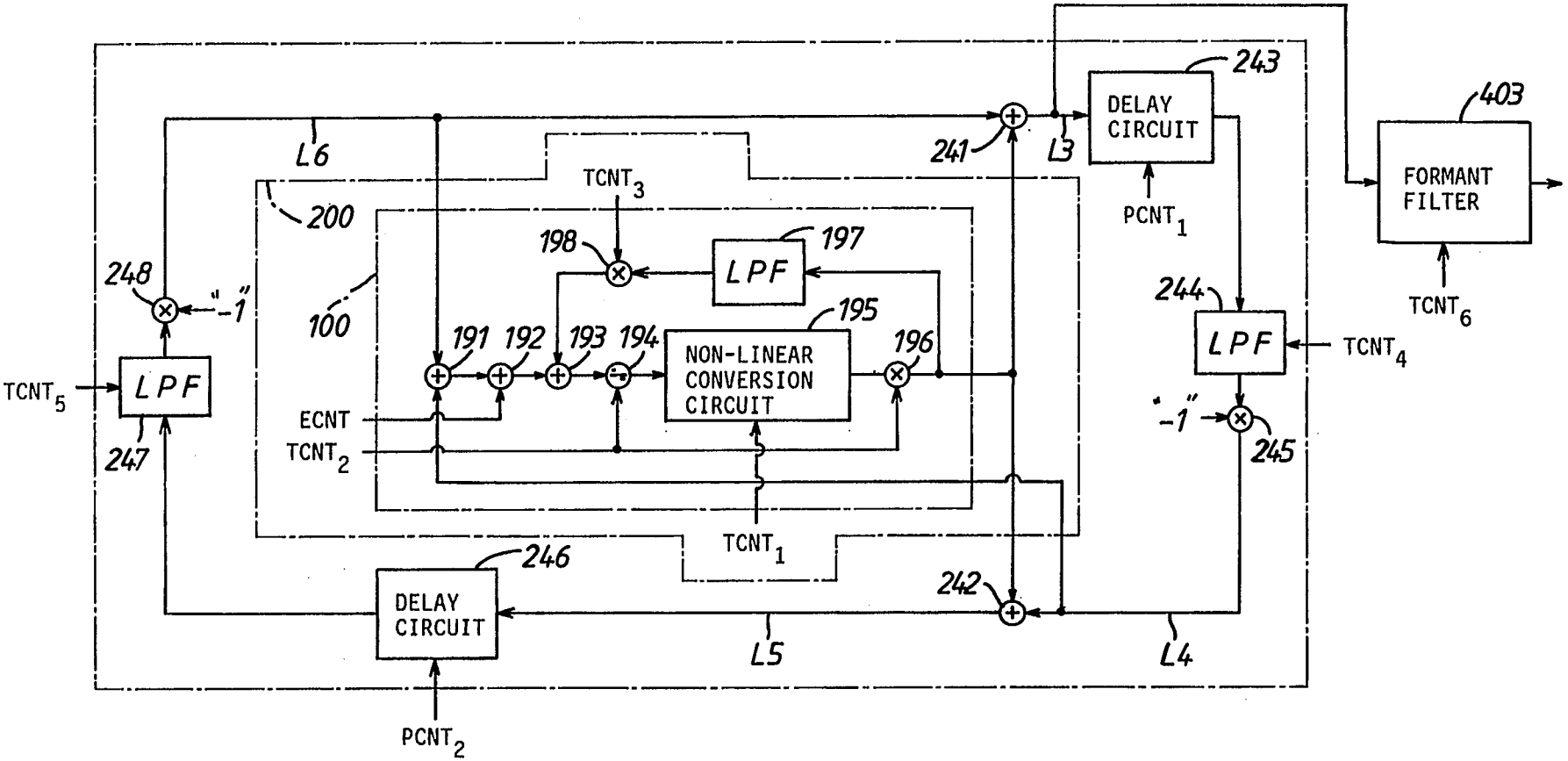
FIG. 28 is a block diagram of a preferred embodiment of a musical tone waveform signal generating apparatus suitable for generating a string instrument tone signal.

With the various kinds of loop circuit portions 300 described above, variation of the air-flow in the mouthpiece 41 of the wind instrument can be simulated to freely effect the formation of various musical tone signals. As shown by broken lines in FIG. 24–27, the loop circuit portions 300 each may be provided at their input sides with a delay circuit 371 for delaying the waveform signal with a short period of time.

e) In FIG. 28 there is illustrated a musical tone waveform signal generating apparatus suitable for generating a musical tone signal of a stringed instrument such as a violin, a viola or the like, which apparatus includes an excitation circuit portion 100 and a signal transmission circuit portion 200 forming a circulation signal passage by signal lines L3–L6. The excitation circuit portion 100 includes an adder 191 arranged to add a waveform signal from signal line L4 to a waveform signal from signal L6 and an adder 192 arranged to add an excitation control signal ECNT applied thereto from the musical tone control signal generating portion 30 to the resultant of addition at adder 191. In this case, the excitation control signal ECNT may correspond with a movement speed of a fiddle bow operated by the performer, while the waveform signal circulating through signal lines L3–L6 may correspond with vibration of the strings. Thus, the addition at adders 191 and 192 is effective to simulate displacement of the fiddle bow in contact with the strings and to simulate displacement of the contact portion of the fiddle bow caused by oscillation of the strings.

The excitation circuit portion 100 further includes a non-linear conversion circuit 195 arranged to be applied with the output of adder 192 through an adder 193 and a divider 194. The non-linear conversion circuit 195 is constructed as shown in FIGS. 2 to 11 to non-linearly convert the output of adder 193 thereby to simulate displacements of the strings caused by movement of the fiddle bow. The conversion characteristic of circuit 195 is defined as shown by solid lines in FIG. 29 to be varied in accordance with the tone-color control signal $TCNT_1$. With such an arrangement of the non-linear conversion circuit 195, performed conditions of the stringed instrument will be simulated under control of the tone color control signal $TCNT_1$ as follows. If the fiddle bow is moved in frictional engagement with the strings at a low speed, the frictional force of the fiddle bow acting on the strings will be defined mainly by a static frictional coefficient, and the vibration speed of the strings will become equal to the movement speed of the bow. If the fiddler bow is moved in frictional engagement with the strings at a high speed, the frictional force of the fiddle bow acting on the strings will be defined mainly by a dynamic frinctional coefficient, and the vibration speed of the strings will become lower than the movement speed of the bow.

The divider 194 is arranged to be applied with the tone-color control signal $TCNT_2$ which corresponds with a pressure of the fiddle bow acting on the strings. The divider 194 acts to divide the output of adder 193 by the tone-color control signal $TCNT_2$ applied thereto. A multiplier 196 is connected at its input side to the non-linear conversion circuit 195 to multiply the output issued therefrom by the tone-color control signal $TCNT_2$. The adder 194 and multiplier 196 are useful to simulate the fact that the coefficients are varied by the pressure of the fiddle bow acting on the strings to cause variation of the non-linear characteristic shown by the solid lines in FIG. 29. That is to say, the division by the tone-color control signal $TCNT_2$ is effective to vary the non-linear characteristic as shown by broken lines in FIG. 29, and the multiplication by the tone-color control signal $TCNT_2$ is effective to vary the chacteristic shown by dot and dash lines in FIG. 29. Thus, the vibration speed of the strings relative to the movement speed of the bow is increased or decreased in accordance with the pressure of the fiddle bow.

Figure 30:
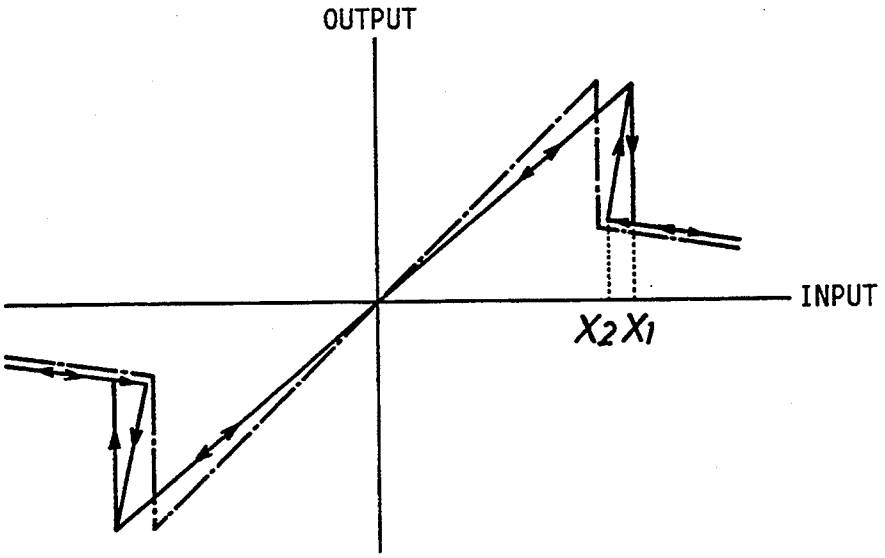

The multiplier 196 is connected at its output side to a low-pass filter 197 which is connected at its output side to the adder 193 through a multiplier 198 to apply a hysteresis characteristic to the non-linear conversion. The multiplier 198 is arranged to be applied with a tone-color control signal $TCNT_3$ indicative of a negative value such as $-0.1$, $-0.2$ or the like. Thus, the adder 193 acts to subtract the output of multiplier 198 from the output of adder 192 and to apply the resultant of subtraction to the divider 194. In FIG. 30, a relationship between the outputs of adder 193 and multiplier 196 is illustrated by dot and dash lines for explanation of the hysteresis characteristic.

Assuming that the non-linear conversion input or the output of adder 192 increases from zero in a positive direction, the non-linear conversion output or the output of multiplier 196 will increase proportionally as shown by a solid line in FIG. 30. Since the output of multiplier 196 becomes a positive large value when the output of adder 192 increases to be $X_1$ and $X_2$, the resultant value of subtraction at adder 193 will become a large value. When the non-linear conversion input reaches the value of $X_1$, the non-linear conversion output is rapidly decreased to a small value and is gradually decreased in accordance with increase of the non-linear conversion input. When the non-linear conversion input is decreased in such a condition described above, the resultant value of subtraction at adder 193 becomes small to cause an increase of the input value of divider 194. When the non-linear conversion input is decreased to the value of $X_2$ less than $X_1$, the non-linear conversion output is rapidly increased. During variation of the non-linear conversion input in a negative direction, the non-linear conversion output is varied substantially in the same manner as described above. In the excitation circuit portion 100, the low-pass filter 197 is effective to prevent oscillation of the non-linear conversion circuit 195, and the multiplier 198 is effective to adjust a feed back gain and to vary the hysteresis in width in accordance with the tone-color control signal $TCNT_3$ applied thereto. If necessary, the characteristic of low-pass filter may be varied in accordance with the tone-color control singal TCNT.

The signal transmission circuit portion 200 includes an adder 241 arranged to add the waveform signal from signal line L6 to the waveform signal from the excitation circuit portion 100 for applying the resultant of addition to the signal line L3 and an adder 242 arranged to add the waveform signal fron signal line L4 to the waveform singal from the excitation circuit portion 100 for applying the resultant of addition to the signal line L5. The waveform signal from adder 241 is transmitted to the signal line L4 through a delay circuit 243, a low-pass filter 244 and a multiplier 245, while the waveform signal from adder 242 is transmitted to the signal line L6 through a delay circuit 246, a low-pass filter 247 and a multiplier 248.

The delay circuits 243 and 246 are arranged to delay the waveform signal in accordance with the pitch control signals $PCNT_1$ and $PCNT_2$ applied thereto from the musical tone control signal generating portion 30 for determination of the pitch of the musical tone to be generated. The low-pass filters 244 and 247 are responsive to the tone-color control signals $TCNT_4$ and $TCNT_5$ to vary the transmission characteristic of the waveform signal for simulating oscillation characteristics of various kinds of strings. The multipliers 245 and 248 are arranged to multiply the waveform signal by "−1" thereby to displace the phase of the waveform signal with $\pi$ for simulating a terminal condition of oscillation waves at the opposite fixed ends of the strings. A formant filter 403 is further connected to the signal line L3 between adder 241 and delay circuit 243 to control the frequency chacteristic of its input in accordance with the tone-color control signal applied thereto for simulating a sound characteristic of the stringed instrument.

In operation of the musical tone waveform generating apparatus described above, the excitation control signal correspoding with the fiddle bow speed is applied to the non-linear conversion circuit 195 through the adders 192,193 and divider 194 to be non-linearly converted and applied therefrom to the adders 241 and 242. Thus, the converted input signal is applied to the signal lines L3 and L5 from the adders 241 and 242 to be circulated through the delay circuit 243, low-pass filter 244, multiplier 245, adder 242, delay circuit 246, low-pass filter 247, multiplier 248 and adder 241. In this instance, the delay times respectively defined by the delay circuits 243 and 246 are controlled in accordance with the pitch control signals $PCNT_1$ and $PCNT_2$ such that the sum of the delay times corresponds with the pitch of the musical tone to be generated. As a result, the circulation period of the converted input signal becomes equal to the pitch frequency of the musical tone. This means that the resonace frequency on the signal lines is controlled to correspond with the musical tone to be generated and that the converted input signal is circulated as a waveform signal having the pitch frequency of the musical tone. During circulation of the waveform signal, low-pass filters 244 and 247 are controlled by the tone-color control signals $TCNT_4$ and $TCNT_5$ to apply a frequency characteristic indicative of the string characteristic to the waveform signal, and the multipliers 245 and 248 acts to displace the phase of the waveform signal with $\pi$ for simulating the terminal condition of oscillation waves at the opposite fixed ends of the strings. Thus, the oscillation waves on the strings is well simulated by the waveform signal. During circulation of the waveform signal, the formant filter 403 is also controlled by the tone-color control signal $TCNT_6$ to apply the sound characteristic of the stringed instrument to the waveform signal. Thus, the musical tone waveform signal generated from formant filter 403 becomes very similar to a musical tone produced by oscillation of the strings.

Figure 29:
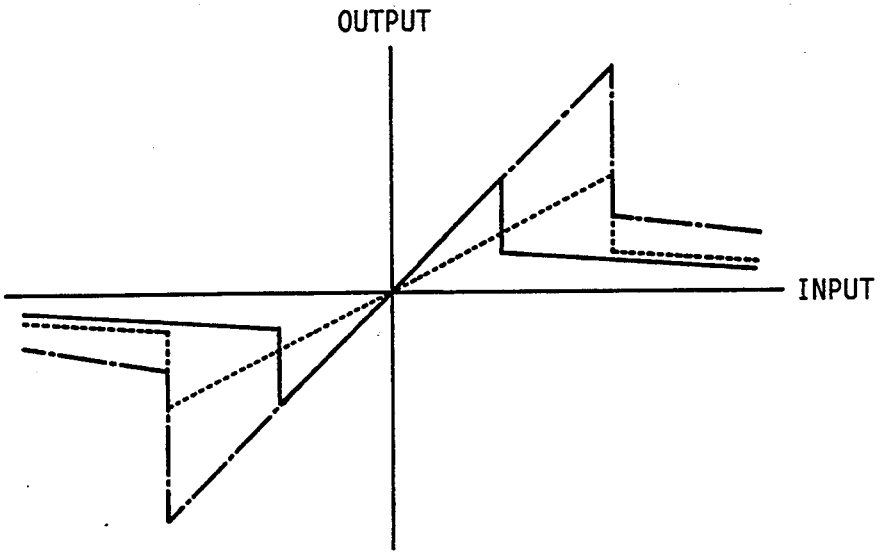
FIGS. 29 and 30 are graphs showing basic conversion characteristics of a non-linear conversion circuit shown in FIG. 28.

The adder 192 is continuously applied with the excitation control signal ECNT and the waveform signal fed back through the adder 191. Thus, the waveform signal is mixed with the excitation control signal ECNT and applied to the non-linear conversion circuit 195 to be non-linearly converted. In this instance, the divider 194 and multiplier 196 are controlled by the tone-color control signal $TCNT_2$ to increase or decrease the non-lieanr conversion output as shown in FIG. 29, and the low-pass filter 197 and multiplier 198 for feed back are controlled by the tone-color control signal $TCNT_3$ to apply the hysteresis characteristic of FIG. 30 to the non-linear conversion output. This is effective to simulate a relationship between the fiddle bow and strings the frictional coefficient of which is varied in accordance with the movement speed of the fiddle bow. Furthermore, the characteristic of the non-linear conversion circuit 195 is variously controlled as shown by the solid line in FIG. 29. This is useful to generate various kinds of musical tone waveform signals related to the stringed instrument.

What is claimed is:

1. A musical tone waveform signal generating apparatus in which a waveform signal is circulated to generate a musical tone waveform signal, the apparatus comprising:

means for producing a control signal for excitation of the waveform signal;

an excitation portion having means for mixing the control signal with the circulating waveform signal to produce a mixed waveform signal and non-linear conversion means for converting the mixed waveform signal in accordance with a non-linear function; and a signal transmission portion coupled with said excitation portion to feed back the converted waveform signal to said excitation portion with a delay of a predetermined time for causing the waveform signal to have a resonance frequency corresponding to a pitch of a musical tone to be generated;

wherein said non-linear conversion means comprises a plurality of non-linear converters connected in parallel to one another to be simultaneously applied with the waveform signal for effecting parallel non-linear conversion of the waveform signal.

2. The apparatus of claim 1 wherein the non-linear converters are comprised of tables.

3. The apparatus of claim 1 wherein the non-linear converters are comprised of arithmetic means for performing arithmetic calculations.

4. A musical tone waveform signal generating apparatus in which a waveform signal is circulated to generate a musical tone waveform signal, the apparatus comprising:

means for producing a control signal for excitation of the waveform signal;

an excitation portion having means for mixing the control signal with the waveform signal to produce a mixed waveform and non-linear conversion means for converting the mixed waveform signal in accordance with a non-linear function; and a signal transmission portion coupled with said excitation portion to feed back the converted waveform signal to said excitation portion with a delay of a predetermined time for causing the waveform signal to have a resonance frequency corresponding to a pitch of a musical tone to be generated;

wherein said non-linear conversion means comprises a plurality of non-linear converters connected in series for successively effecting non-linear conversion of the waveform signal applied thereto and for applying the converted waveform signal to said signal transmission portion.

5. A musical tone waveform signal generating apparatus in which a waveform signal is circulated to generate a musical tone waveform signal, the apparatus comprising:

means for producing a control signal for excitation of the waveform signal;

an excitation portion having means for mixing the control signal with the circulating waveform signal and non-linear conversion means for converting the mixed waveform signal in accordance with a non-linear function; and a signal transmission portion coupled with said excitation portion to feed back the converted waveform signal to said excitation portion with a delay of a predetermined time for causing the waveform signal to have a resonance frequency corresponding to a pitch of a musical tone to be generated;

wherein said non-linear conversion means comprises a plurality of non-linear converters having conversion characteristics which are different from each other.

6. The apparatus of claim 5 wherein each of said non-linear converters comprises means for performing calculation of a predetermined non-linear function.

* * * * *